US009848690B2

(12) United States Patent
Rohrbach et al.

(10) Patent No.: US 9,848,690 B2
(45) Date of Patent: Dec. 26, 2017

(54) HIGH STRENGTH RETENTION LOOPS FOR WEARABLE BANDS

(71) Applicant: Apple Inc., Cupertino, CA (US)

(72) Inventors: Matthew D. Rohrbach, Cupertino, CA (US); James J. Griffin, II, Cupertino, CA (US); Edward Siahaan, Cupertino, CA (US); Benjamin A. Shaffer, Cupertino, CA (US); Adam K. Eschner, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 38 days.

(21) Appl. No.: 14/696,452

(22) Filed: Apr. 26, 2015

(65) Prior Publication Data

US 2016/0058164 A1 Mar. 3, 2016

Related U.S. Application Data

(60) Provisional application No. 62/044,910, filed on Sep. 2, 2014.

(51) Int. Cl.
*A45F 5/00* (2006.01)
*A44C 5/00* (2006.01)

(52) U.S. Cl.
CPC ..... *A45F 5/00* (2013.01); *A44C 5/0053* (2013.01); *A45F 2005/008* (2013.01)

(58) Field of Classification Search
CPC ..... A44C 5/2009; A44C 5/00; A44C 5/0053; A45F 2005/008
USPC ..... 224/164–178; 24/265 WS; 368/281–282; 428/36.1–36.2, 58–60, 473
See application file for complete search history.

(56) References Cited

U.S. PATENT DOCUMENTS 2,657,161 A 10/1953 Luitwieler
2,788,163 A * 4/1957 Butts ..... A44C 5/0053 224/175
3,369,722 A * 2/1968 Hetterich ..... A44C 5/0053 224/173
3,378,181 A 4/1968 Hirsch
3,905,046 A * 9/1975 Hirsch ..... A44C 5/0053 2/322
4,512,274 A 4/1985 Campbell, Jr. et al.
4,849,145 A * 7/1989 Hirsch ..... A44B 11/06 264/135
5,209,482 A * 5/1993 Hopfer ..... A63B 21/4007 473/216
6,436,502 B1 * 8/2002 Swift ..... B29C 65/56 428/60
6,830,166 B1 * 12/2004 Laats ..... A44C 5/0053 224/164

(Continued)

*Primary Examiner* — Scott McNurlen
(74) *Attorney, Agent, or Firm* — McDermott Will & Emery LLP

(57) ABSTRACT

A high strength retention loops for a wearable band of an electronic device and method of forming the retention loop. The retention loop of the wearable band may include a bottom layer, a tensile member encircling the bottom layer, and a top layer positioned adjacent to and substantially encircling the bottom layer and the tensile member. A distinct retention loop may include a single piece of folded leather material having an exterior portion, and two interior portions positioned adjacent the outer portion. The distinct retention loop may also include a tensile member positioned between the exterior portion and the two interior portions.

12 Claims, 28 Drawing Sheets

(56) References Cited

U.S. PATENT DOCUMENTS

2014/0044990 A1* 2/2014 Tsukamoto ..... A44C 27/006
428/661

* cited by examiner

HIGH STRENGTH RETENTION LOOPS FOR WEARABLE BANDS

CROSS-REFERENCE TO RELATED APPLICATION

This application is a nonprovisional patent application of and claims the benefit to U.S. Provisional Patent Application No. 62/044,910, filed Sep. 2, 2014 and titled "High Strength Retention Loops for Wearable Bands," the disclosure of which is hereby incorporated herein by reference in its entirety.

TECHNICAL FIELD

The disclosure relates generally to electronic devices, and more particularly to retention loops for a wearable band of an electronic device and a method of forming the retention loops for the wearable band.

BACKGROUND

Conventional wearable electronic devices include bands that couple the electronic device to a user or a desired object for holding the electronic device (e.g., bicycle handlebar). For example, a conventional wristwatch typically includes a band that attaches the watch to a user's wrist. There are many varieties of conventional wearable bands for watches including, but not limited to, elastic bands, flexible bands including buckles, and metal bands including metal clasp. However, each of these conventional bands may include negative aspects, and may undesirably fail prior to the end of the expected operational life of the wearable electronic device.

For example, the conventional elastic band may lose its elastic properties over time, and may become too big for a user's wrist, which may result in the electronic device unexpectedly slipping from a user's wrist and being damaged. In another example, the material forming the flexible bands may tear or deteriorate over time due to normal use over the operational life of the band and/or the concentrated force applied at the hole of the flexible band by the tongue of the buckle. The metal bands including the metal clasp may include a plurality of components all coupled together, which may fail, become uncoupled or malfunction over time. That is, the plurality of components forming the metal band may become damaged, not function properly over time, or may become uncoupled, rendering the metal band incapable of attaching the wearable electronic device to a user. When a conventional wearable band fails and/or is incapable of securely attaching the electronic device to a user's wrist, the band needs to be replaced and/or the wearable electronic device may be susceptible to damage.

Additionally, conventional wearable bands include retention loops for securing free ends of the wearable band, and/or prevent the free ends from undesirably contacting or catching other objects. When the free end of the conventional wearable band contacts or is caught on other objects the wearable band may come undone or uncoupled, which may result in the wearable electronic device being undesirably uncoupled from a user. These conventional retention loops may also be formed from a plurality of materials, and may undergo a plurality of processes for forming just a small portion of the conventional wearable band. Similar to the wearable band itself, with an increase in the amount of materials forming the retention loop, the risk of failure and/or damage to the retention loop may increase over the operational life of the conventional wearable band including the retention loop. Additionally, as a result of the multiple materials used to form conventional retention loops, the cost, and/or manufacture time may increase for the conventional wearable band including the retention loop. To decrease cost and/or manufacture time, conventional retention loops may be made using simple manufacturing processes. However, this may result in less desirable aesthetic and/or visually appealing (e.g., exposed threads, unfinished ends, distinguishable layers of material, and the like) retention loops.

SUMMARY

Generally, embodiments discussed herein are related to retention loops for a wearable band of an electronic device and a method of forming the retention loops for the wearable band. The retention loops may be formed using a tensile member as an intermediate layer to provide added stiffness, rigidity and/or structure to the retention loop. Additionally, the retention loops may be formed from a plurality of layers, including multiple layers of leather material and/or the tensile member, in such a way to make the retention loop strong, as well as, aesthetically appealing to a user of the wearable band. The retention loops may be formed using methods to provide both high tensile strength, a visually appealing retention loop (e.g., a single seam visible to a user).

One embodiment may include a retention loop for a wearable band. The retention loop may include a bottom layer. The bottom layer may comprise a first reduced thickness portion positioned at a first end of the bottom layer, and a second reduced thickness portion positioned at a second end of the bottom layer and opposite the first end. The second reduced thickness portion may be coupled to the first reduced thickness portion to maintain a uniform thickness of the bottom layer. The retention loop may also comprise a tensile member encircling the bottom layer, and a top layer positioned adjacent to and substantially encircling the bottom layer and the tensile member.

Another embodiment may include a method of forming a plurality of retention loops for a wearable band. The method may include wrapping a bottom layer of material around a mandrel to form an inner loop, coupling a tensile member around the bottom layer of material, and inserting the bottom layer of material and the tensile member into an opening formed in a top layer of material. The method may also include coupling the top layer of material to the tensile member and the bottom layer of material to form a loop assembly, and cutting through the loop assembly.

A further embodiment may include a distinct retention loop for a wearable band. The retention loop may include a tensile member, and a single piece of folded leather material encircling the tensile member. The single piece of folded leather material may comprise an exterior portion, and two interior foldable portions positioned adjacent the outer portion. Each of the two interior foldable portions may be folded over a portion of the tensile member to cover the tensile member.

An additional embodiment may include a method of forming an individual retention loop for a wearable band. The method may include stitching a single piece of leather material proximate two joined ends of the leather material using a thread, cutting a portion of selvedge material formed adjacent the thread to form an exterior portion and two interior foldable portions of the single piece of leather material, and fixing a centralized selvedge portion of the selvedge material to the single piece of leather material. The centralized selvedge portion defines the exterior portion of the single piece of leather material. The method may also include wrapping a tensile member around the single piece of leather material and the centralized selvedge portion, folding the two interior foldable portions of the single piece of leather material over the tensile member, and turning the single piece of leather material and the tensile member inside out to expose the outer portion of the single piece of leather material.

BRIEF DESCRIPTION OF THE DRAWINGS

The disclosure will be readily understood by the following detailed description in conjunction with the accompanying drawings, wherein like reference numerals designate like structural elements, and in which.

Figure 1:
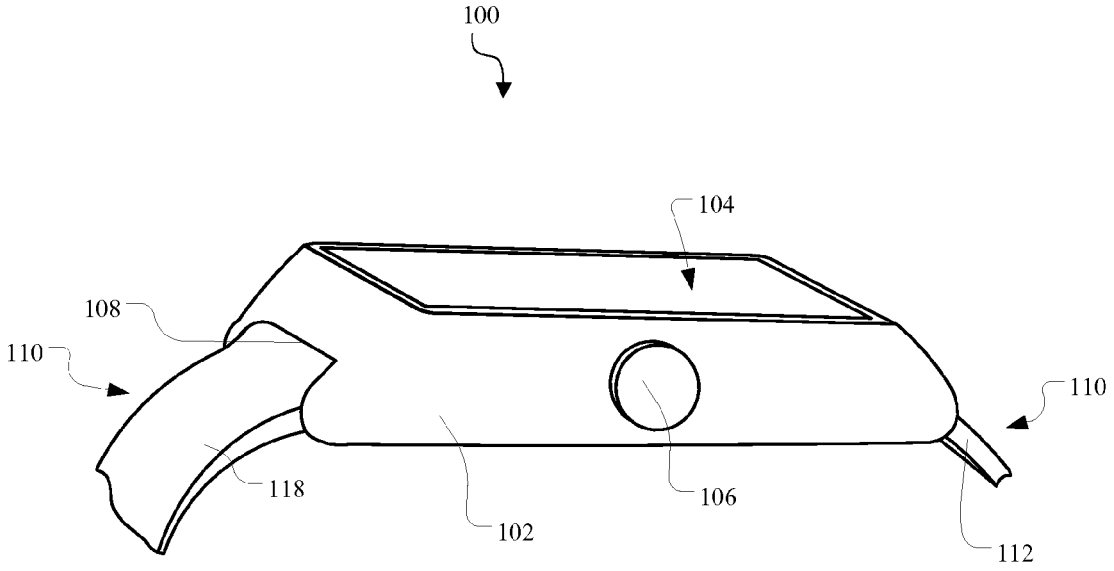
FIG. 1 depicts an illustrative perspective view of a wearable electronic device including a portion of a wearable band, according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to an electronic device, and more particularly, to retention loops for a wearable band of an electronic device and a method of forming the retention loops for the wearable band.

The retention loops may be formed using a tensile member as an intermediate layer to provide added stiffness, rigidity and/or structure to the retention loop. Additionally, the retention loops may be formed from a plurality of layers, including multiple layers of leather material and/or the tensile member, in such a way to make the retention loop strong, as well as, aesthetically appealing to a user of the wearable band. The retention loops may be formed using methods to provide both high tensile strength, a visually appealing retention loop (e.g., a single seam visible to a user).

These and other embodiments are discussed below with reference to FIGS. 1-10. However, those skilled in the art will readily appreciate that the detailed description given herein with respect to these Figures is for explanatory purposes only and should not be construed as limiting.

FIG. 1 shows an illustrative perspective view of a portable or wearable electronic device 100, according to embodiments. Wearable electronic device 100, as shown in FIG. 1, may be configured to provide health-related information or data such as, but not limited to, heart rate data, blood pressure data, temperature data, oxygen level data, diet/nutrition information, medical reminders, health-related tips or information, or other health-related data. The wearable electronic device may optionally convey the health-related information to a separate electronic device such as a tablet computing device, phone, personal digital assistant, computer, and so on. In addition, wearable electronic device 100 may provide additional information, such as but not limited to, time, date, health, statuses or externally connected or communicating devices and/or software executing on such devices, messages, video, operating commands, and so forth (and may receive any of the foregoing from an external device), in addition to communications.

Wearable electronic device 100 may include a housing 102 at least partially surrounding a display 104 and one or more buttons 106 or input devices. The housing 102 may form an outer surface or partial outer surface and protective case for the internal components of wearable electronic device 100, and may at least partially surround the display 104. The housing 102 may be formed of one or more components operably connected together, such as a front piece and a back piece. Alternatively, the housing 102 may be formed of a single piece operably connected to the display 104. Housing 102 may include a plurality of distinct materials including, but not limited to: corundum, commonly referred to as sapphire, metal, glass or plastic. Additionally, housing 102 may include a decorative and/or coating layer that be disposed on the outer and/or or inner surface of housing 102. The decorative layer and/or coating layer may be disposed on the surface(s) of housing 102 to protect the enclosure and/or provide a decorative feature (e.g., exterior color) for electronic device 100.

Housing 102 may also include recesses 108 formed on opposite ends to connect a wearable band 110 (partially shown in FIG. 1) to wearable electronic device 100. As shown in FIG. 1, and discussed herein, wearable band 110 may include a first strap portion 112 coupled to housing 102, and a second strap portion 118 positioned opposite first strap portion 112 and coupled to housing 102. Wearable band 110, and specifically first strap portion 112 and second strap portion 118, may be used to secure wearable electronic device 100 to a user, or any other object capable of receiving wearable electronic device 100. In a non-limiting example where wearable electronic device 100 includes a smart watch, wearable band 110 may secure the watch to a user's wrist. In other non-limiting examples, wearable electronic device 100 may be secured to another part of a user's body. Additionally in other non-limiting examples discussed herein, wearable band 110 may be formed as a single component coupled to housing 102 or as two distinct components coupled to opposite ends of housing 102.

Display 104 may be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology.

Button 106 may include any suitable input/output (I/O) device for electronic device 100. Specifically, button 106 may include an actuation component in electronic and/or mechanical communication with the internal components of electronic device 100, to provide user input and/or allow the user to interact with the various functions of electronic device 100. In an embodiment, button 106 may be configured as a single component surrounded by housing 102. Alternatively, button 106 may include a plurality of components, including an actuation component, in mechanical/electrical communication with one another and/or internal component of electronic device 100.

Figure 2:
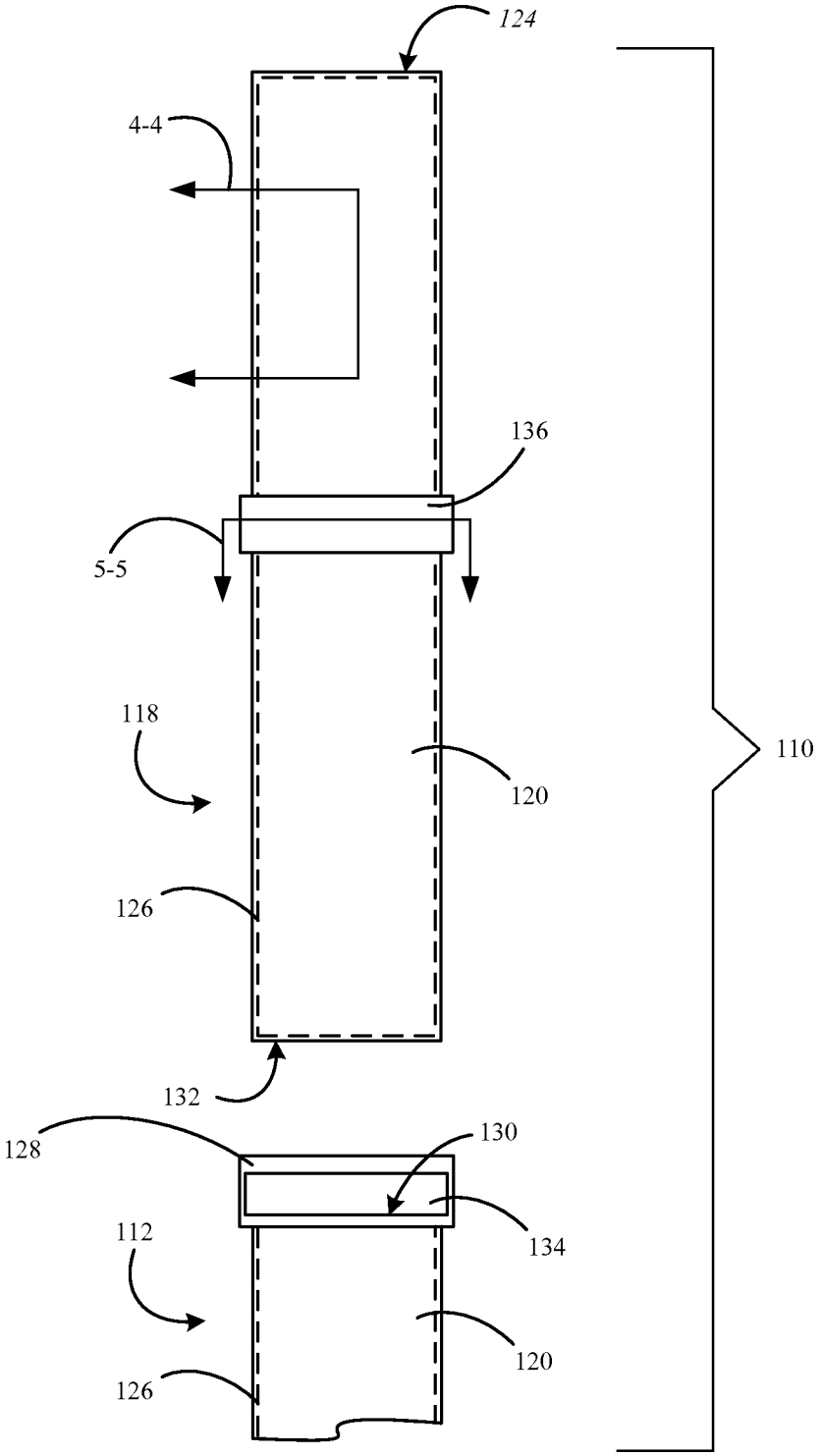
FIG. 2 shows an illustrative top view of the wearable band as shown in FIG. 1, according to embodiments of the invention.

FIG. 2 shows an illustrative top view of wearable band 110 of FIG. 1. Specifically, FIG. 2 may show first strap portion 112 and second strap portion 118 forming wearable band 110 for wearable electronic device 100. First strap portion 112 and second strap portion 118 may be formed from substantially the same material or any material including similar flexible and/or deformable characteristics. In a non-limiting example, first strap portion 112 and second strap portion 118 may be formed from a leather material.

First strap portion 112 and second strap portion 118 may be formed from a top layer 120 and a bottom layer 122 (see, FIG. 4) of material (e.g., leather) bonded or coupled to one another. First strap portion 112 and second strap portion 118 may be formed using a single piece of material or multiple pieces of material, where first strap portion 112 and second strap portion 118 include top layer 120 and bottom layer 122. In a non-limiting example, each of first strap portion 112 and second strap portion 118 may be formed from single, distinct pieces of material. The single piece of material may be folded over itself to form top layer 120 and bottom layer 122, and the folded portion may be positioned at a housing end 124 (e.g., second strap portion 118). Housing end 124 of first strap portion 112 (not shown) and/or second strap portion 118 may be coupled to and/or positioned within recess 108 to couple wearable band 110, and specifically first strap portion 112 and second strap portion 118, to housing 102 of wearable electronic device 100 (see, FIG. 1). In another non-limiting example, first strap portion 112 and second strap portion 118 may be formed from multiple pieces of material, where each distinct piece of material forms top layer 120 or bottom layer 122 for first strap portion 112 and/or second strap portion 118. In an additional non-limiting example discussed herein, wearable band 110 may be formed from a single piece of material, such that first strap portion 112 and second strap portion 118 are integrally formed.

First strap portion 112 and second strap portion 118 may include a coupling component 126 (shown in phantom) positioned substantially around and/or adjacent to the perimeter of the respective strap portions. Coupling component 126 may include an suitable material or technique that may be used to couple top layer 120 and bottom layer 122 to one another to form first strap portion 112 and/or second strap portion 118. Additionally, and as discussed herein, coupling component 126 may be utilized within first strap portion 112 and/or second strap portion 118 to ensure internal components of the respective straps remain within and/or between top layer 120 and bottom layer 122. In a non-limiting example, coupling component 126 may include an adhesive or bonding adjacent positioned adjacent the perimeter of first strap portion 112 and/or second strap portion 118 to bond top layer 120 to bottom layer 122. In another non-limiting example, coupling component 126 may include a thread that may pass through top layer 120 and bottom layer 122 around the perimeter of first strap portion 112 and/or second strap portion 118 to couple top layer 120 to bottom layer 122.

As shown in FIG. 2, first strap portion 112 may include a loop 128 positioned at an end 130 adjacent a second strap portion 118. A free end 132 of second strap portion 118 may be feed and/or positioned through opening 134 of loop 128, and a portion of second strap portion 118 may be folded back on itself to couple wearable electronic device 100 (see, FIG. 1) to a user or a desired object. The folded portion of second strap portion 118 may be coupled to the remaining portion of second strap portion 118 using any suitable technique including, but not limited to, magnets embedded into second strap portion 118, hook-and-loop fasteners (e.g., Velcro®) position on at least a portion of second strap portion 118, and the like. In a non-limiting example, loop 128 may be formed from a distinct material or component that may be coupled to the material forming first strap portion 112 (see, FIG. 2).

As shown in FIG. 2, wearable band 110 may also include a retention loop 136 positioned on and/or substantially around second strap portion 118. As discussed herein, retention loop 135 may aid in securing free end 132 and/or a portion of second strap portion 118 to the remainder of second strap portion 118 when free end 132 is positioned through loop 128 and folded back onto the remaining portion of second strap portion 118. Retention loop 136 may form an opening (not shown) located between second strap portion 118 of wearable band 110 and retention loop 136, where the opening may receive free end 132 and/or a portion of second strap portion 118. In a non-limiting example, retention loop 135 may be coupled to and/or fixed in a predetermined position of second strap portion 118. In another non-limiting example, retention loop 135 may surround second strap portion 118, and may be free to move over the length of second strap portion 118 of wearable band 110.

Although shown herein as including two distinct straps (e.g., first strap portion 112, second strap portion 118), wearable band 110 may be formed from a single strap. In a non-limiting example shown in FIG. 3, wearable band 210 may be formed as a single strap, such that first strap portion 212 and second strap portion 218 may be integrally formed. It is understood that similarly named components or similarly numbered components may function in a substantially similar fashion, may include similar materials and/or may include similar interactions with other components. Redundant explanation of these components has been omitted for clarity.

As discussed herein, wearable band 210 may be formed from a single piece of material. In a non-limiting example, wearable band 210 may be formed from a single piece of material (e.g., leather), where top layer 220 is folded over and positioned above bottom layer (not shown) to form wearable band 210. Where wearable band 210 is formed from a single piece of material, the fold in the material to differentiate between top layer 220 and bottom layer 222 may be positioned at end 230 including buckle clasp 238. The single piece of material forming wearable band 210 may be feed through opening 234 of buckle clasp 238, and buckle clasp 238 may be partially positioned between top layer 220 and bottom layer 222, and secured at end 230 of wearable band 210. In another non-limiting example, not shown, single strap wearable band 210 may be formed from two pieces of material, where each piece of material forms a respective layer (e.g., top, bottom) of wearable band 210.

Figure 3:
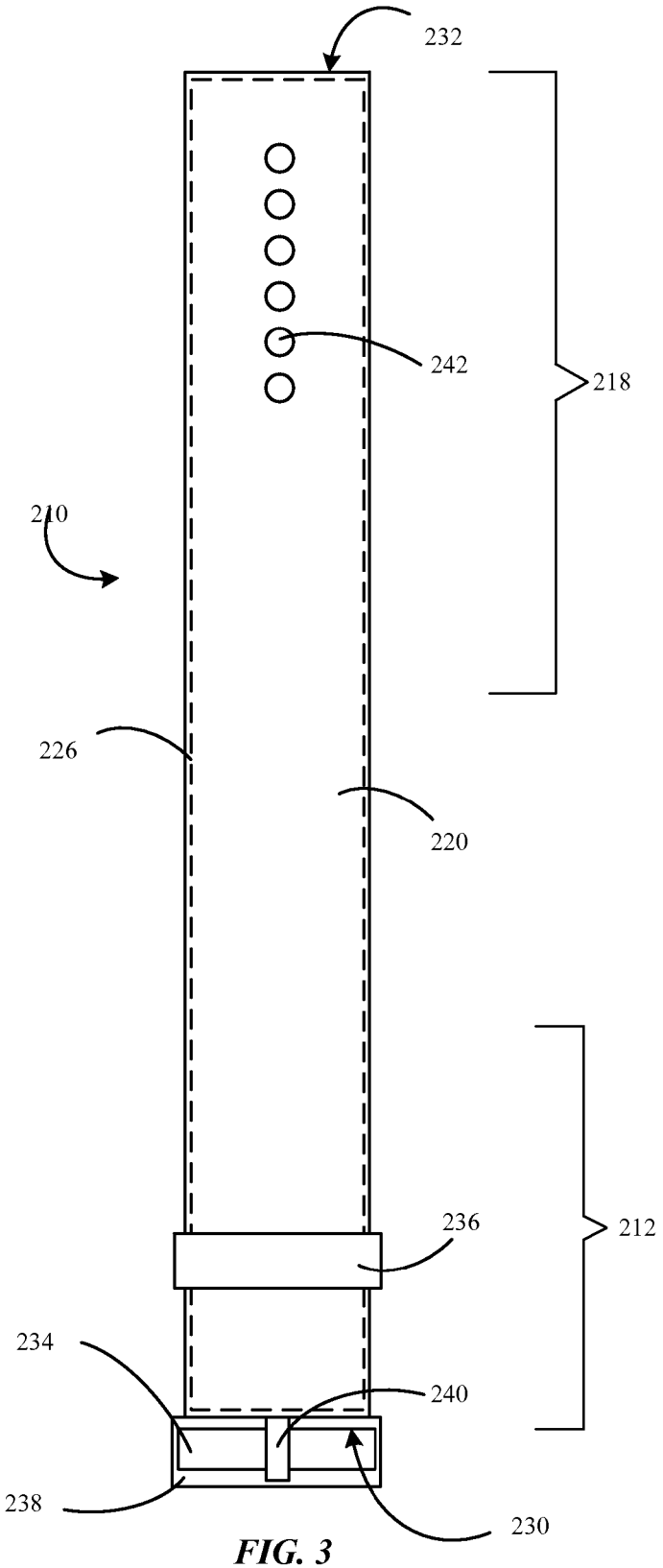
FIG. 3 shows an illustrative top view of a wearable band, according to further embodiments of the invention.

Wearable band 210, as shown in FIG. 3, may couple wearable electronic device 100 (see, FIG. 1) to a user by utilizing buckle clasp 238. In a non-limiting example, opening 234 of buckle clasp 238 may receive free end 232 and/or a portion of second strap portion 228, and a tongue 240 of buckle clasp 238 may be positioned within one of a plurality of holes 242 formed adjacent free end 232 to secure wearable band 210 to a user. As discussed herein with respect to FIG. 2, retention loop 236 may aid in securing free end 232 and/or a portion of second strap portion 228 to a portion of wearable band 210, when second strap portion 218 is coupled to buckle clasp 238.

Figure 4:
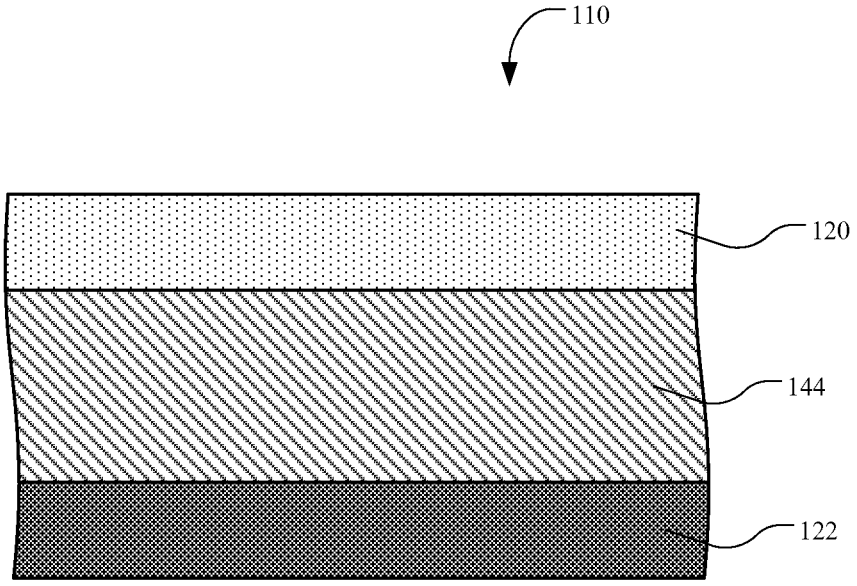
FIG. 4 shows an enlarged cross-section side view of a portion of wearable band for the electronic device including a tensile member taken along line 4-4 of FIG. 2, according to embodiments of the invention.

FIG. 4 shows an enlarged cross-section side view of a portion of wearable band 110 for an electronic device 100 taken along line 4-4 of FIG. 2. Wearable band 110 may include leather material for forming top layer 120 and bottom layer 122, as discussed herein. Additionally, wearable band 110 may also include a tensile member 144. Tensile member 144 may be placed or positioned between top layer 120 and bottom layer 122 of wearable band 110. As shown in FIG. 4, tensile member 144 may be sandwiched between and/or coupled to at least one of top layer 120 and bottom layer 122. Tensile member 144 may be positioned within wearable band 110 to add structure and/or stiffness to wearable band 110. As such, tensile member 144 may be formed from any suitable material that may add structural support and/or stiffness to wearable band 110, such as a molded elastomer, liquid crystal polymer fibers (e.g., Vectran®), aromatic polyester fibers, para-aramid fibers (e.g., Kevlar®), polyamide fibers (e.g., Nylon®), and the like.

In addition to being used with wearable band 110, tensile member 144 may be used with a retention loop 136 of wearable band 110. Retention loop 136 may be positioned on wearable band 110 for receiving and/or maintaining free end 132 of wearable band 110 (see, FIG. 2) on the remainder of wearable band 110, as discussed herein.

Figure 5:
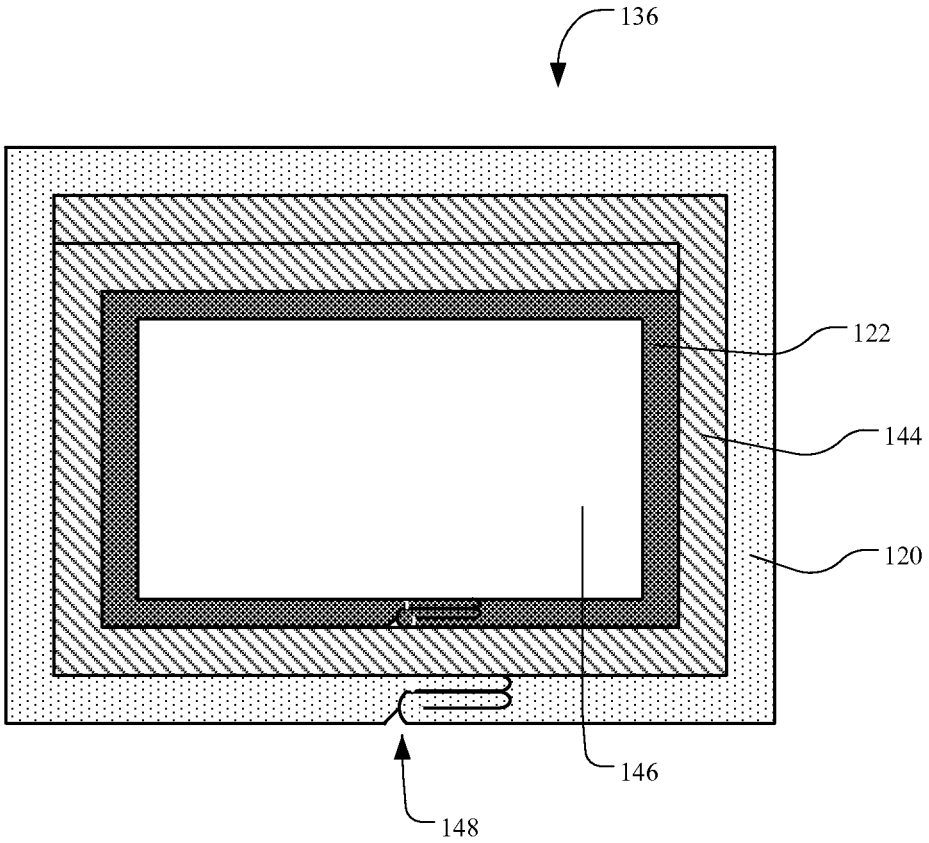
FIG. 5 shows an enlarged front cross-section view of a retention loop for a wearable band of an electronic device taken along line 5-5 of FIG. 2, according to embodiments of the invention.

FIG. 5 shows an enlarged front cross-section view of retention loop 136 for wearable band 110 of an electronic device 100 taken along line 5-5 of FIG. 2. Retention loop 136 may be formed from a plurality of layers that form a loop of material and opening 146. Opening 146 of retention loop 136 may receive wearable band 110 and a free end of wearable band 110 when electronic device 100 is coupled to a user. As shown in FIG. 5, and similarly discussed herein with respect to FIG. 4, tensile member 144 may be formed between top layer 120 and bottom layer 122 of retention loop 136. Additionally, as shown in FIG. 5, tensile member 144 may include at least a portion that may be overlapped when formed within retention loop 136.

seam 148 FIGS. 6A-6D show a front view of top layer 120 of retention loop 136 undergoing a process of formation. Specifically, FIGS. 6A-6D show top layer 120 undergoing a process of formation, such that only seam 148 (see, FIG. 6D) may be visible to a user of wearable band 110 including retention loop 136.

Figure 6A:
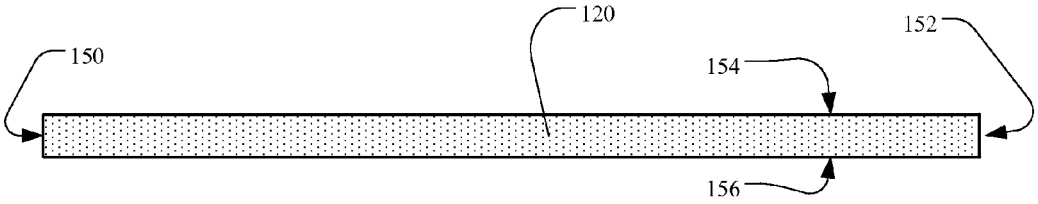
FIGS. 6A-6D show an enlarged front view of a leather material undergoing a process for forming a retention loop for a wearable band of an electronic device, according to embodiments of the invention.

FIG. 6A shows a single piece of leather forming top layer 120 of retention loop 136. The single piece of leather may include a first end 150, and a second end 152, positioned opposite first end 150. Additionally, single piece of leather forming top layer 120 may also include an interior surface 154, and an exterior surface 156. As discussed herein, interior surface 154 may be coupled to tensile member 144 when top layer 120 is utilized within retention loop 136. Additionally, and as discussed herein, exterior surface 156 may be exposed to a user when top layer 120 is utilized in the formation of retention loop 136.

Figure 6B:
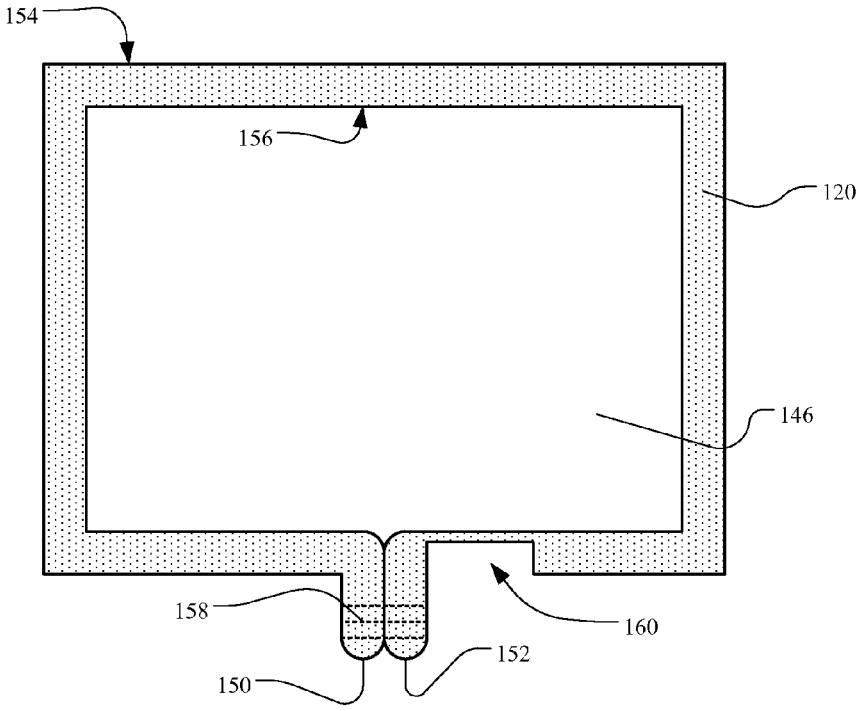

FIG. 6B shows first end 150 and second end 152 of top layer 120 positioned adjacent one another. In a non-limiting example, first end 150 and second end 152 may be positioned adjacent one another and may be folded so exterior surface 156 of first end 150 and second end 152 contact each other. Once positioned adjacent to one another, first end 150 and second end 152 of top layer 120 may be coupled together. In the non-limiting example shown in FIG. 6B, a thread 158, shown in phantom, may be positioned through first end 150 and second end 152 to join the respective ends to one another and form a loop having opening 146. Thread 158 may be any suitable thread material that may be used to ensure a bond between first end 150 and second end 152 of top layer 120.

Additionally as shown in FIG. 6B, a cutout or trench 160 may be formed in a portion of top layer 120 adjacent the bonded edges of top layer 120. Trench 160 may be formed partially through interior surface 154 of top layer 120 adjacent the coupled and/or threaded first end 150 and second end 152. Trench 160 may be formed in top layer 120 of leather material using any suitable technique for removing a portion of material. Additionally, and as discussed herein, trench 160 may receive first end 150 and second end 152 for maintaining a substantially equal width or thickness of top layer 120 utilized to form retention loop 136.

Figure 6C:
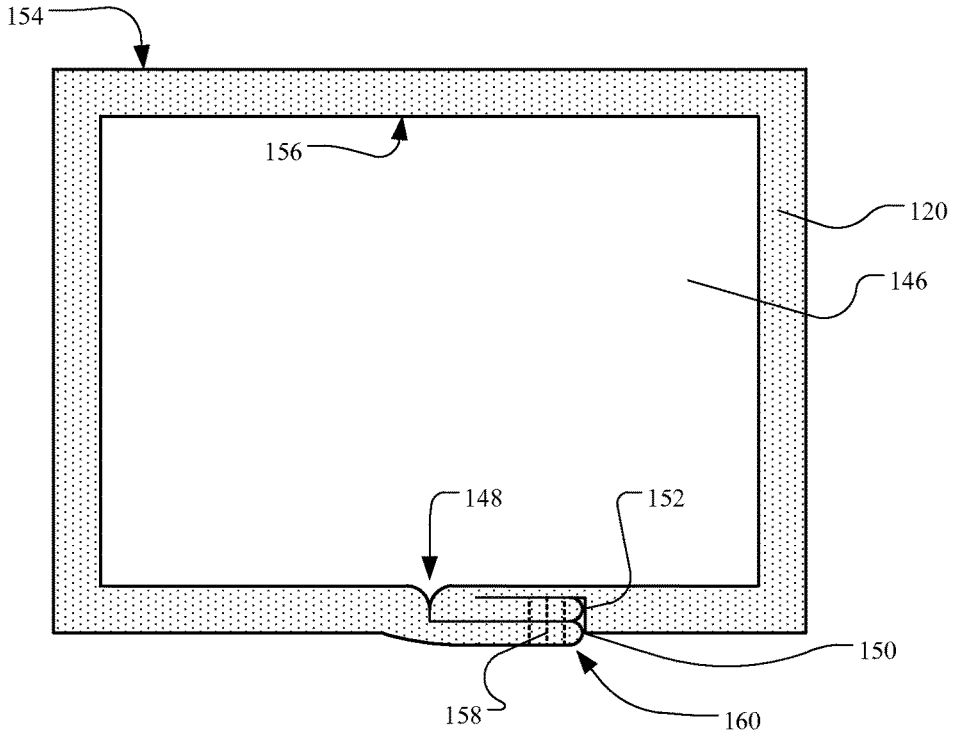

Turning to FIG. 6C, subsequent to the bonding or coupling of first end 150 and second end 152, the respective ends of top layer 120 may be folded over and/or positioned within trench 160. In a non-limiting example, first end 150 and second end 152 may be bonded using threads 158, and may be subsequently folded over into trench 160, such that first end 150 is positioned closest to inner surface 154, and second end 152 is positioned closest to exterior surface 156. By forming trench 160 in top layer 120, and subsequently positioning the respective ends of top layer within trench 160, the thickness of top layer 120 may remain substantially uniform. First end 150 and second end 152 may be secured within trench 160 of top layer 120 using an suitable technique or component such as, but not limited to, adhesive, welding, melting or embossing.

Additionally, portions of ends 150, 152 of top layer 120 may also have a reduced thickness to ensure a uniform thickness for top layer 120. In a non-limiting example, a thickness of each of first end 150 and second end 152 of top layer 120 may be reduced prior to positioning the ends 150, 152 within trench 160. The reduction in the thickness of the coupled first end 150 and second end 152 of top layer 120 may allow top layer 120 to maintain a uniform thickness over the portion that includes trench 160.

As shown in FIG. 6C, seam 148 may be formed on exterior surface 156 of top layer 120 as a result of folding first end 150 and second end 152 into trench 160. Seam 148 may be formed as a result of exterior surface 156 of first end 150 and second end 152 coming in contact with one another, without over lapping each other. Seam 148 may be substantially small in size, and may only show a minimal transition in material when coupling first end 150 to second end 152 to form the loop in retention loop 136 (see, FIG. 5). As shown in FIG. 6C, seam 148 may be positioned adjacent opening 146.

Figure 6D:
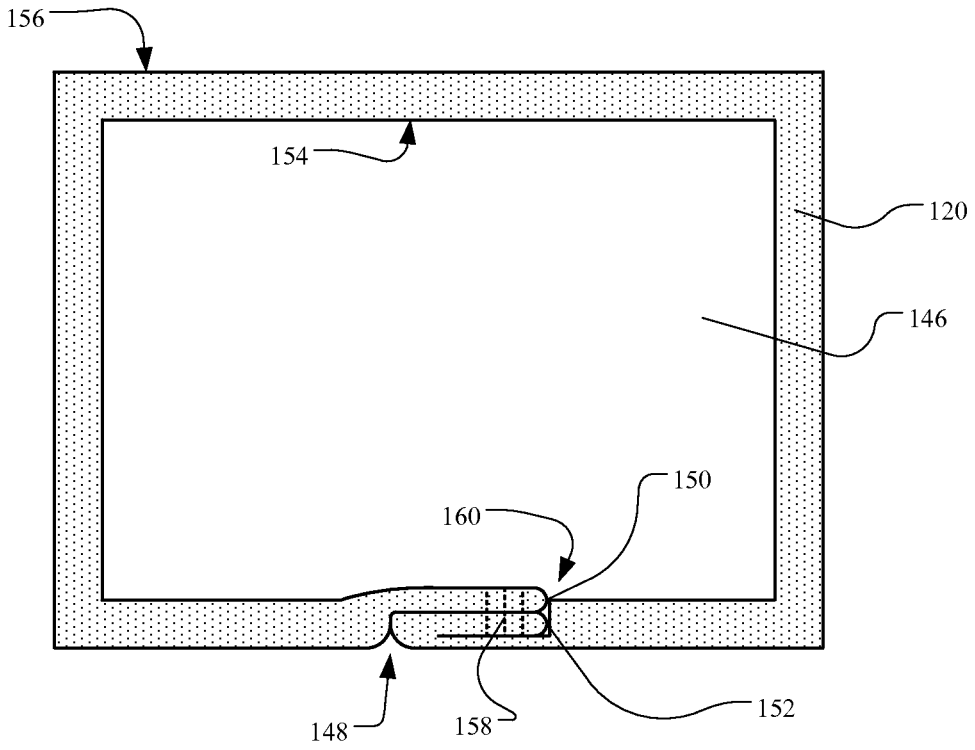

As shown in FIG. 6D, prior to being used in retention loop 136 (see, FIG. 4) or prior to top layer 120 being used solely as retention loop 26 for a wearable band 110, top layer 120 including seam 148 may be reversed or may be folded right-side in. That In a non-limiting example shown in FIG. 6D with comparison to FIG. 6C, top layer 120 may be folded around, such that exterior surface 156 is now positioned on the exterior of opening 146, and interior surface 154 is now positioned adjacent opening 146. Additionally, by turning top layer 120 right-side-in (e.g., exposing exterior surface 156) seam 148 may now be exposed to a user of wearable band 110 including retention loop 136 having top layer 120. By exposing seam 148 instead of the bonded ends of top layer 120, a more visually desirable and/or aesthetically pleasing exterior surface 156 may be exposed to a user, while also forming top layer 120 from a single piece of leather material.

FIGS. 7A-7K depict a process of forming a retention loop 336 for a wearable band 110 (see, FIG. 2). In non-limiting embodiments, FIGS. 7A-7K show a process of formation of the retention loop 336, where retention loop 336 includes top layer 320, bottom layer 322 and tensile member 344 positioned there between. It is understood that similarly named components or similarly numbered components may function in a substantially similar fashion, may include similar materials and/or may include similar interactions with other components. Redundant explanation of these components has been omitted for clarity.

Figure 7A:
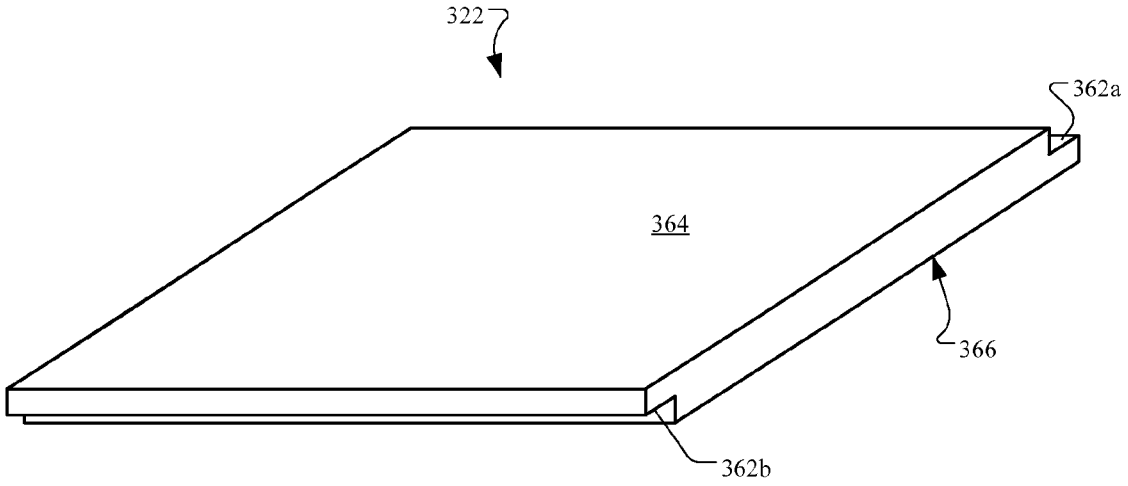
FIG. 7A shows an illustrative perspective view of a bottom layer undergoing processes for forming a retention loop, according to embodiments.

FIG. 7A depicts an illustrative perspective view of bottom layer 322 utilized in forming retention loop 336. Bottom layer 322 may be formed from a distinct piece of material, such as leather, when forming retention loop 336 (see, FIG. 7K), as discussed herein. As shown in FIG. 7A, bottom layer 322 may include a reduced thickness portions 362*a*, 362*b* positioned on opposite sides of bottom layer 322. That is, a first reduced thickness portion 362*a* may be formed on a first end partially through a first surface 364 of bottom layer 322. In the non-limiting example, first reduced thickness portion 362*a* may reduce the thickness of a portion of bottom layer 322 by approximately half of the thickness of bottom layer 322.

Additionally, a second reduced thickness portion 362*b* may be formed on a second end, opposite the first end of bottom layer 322 having the first reduced thickness portion 362*a*. Second reduced thickness portion 362*b*, as shown in FIG. 7A, may be formed partially through a second surface 366 of bottom layer 322. Similar to first reduced thickness portion 362*a*, and in a non-limiting example, second reduced thickness portion 362*b* may reduce the thickness of a portion of bottom layer 322 by approximately half of the thickness of bottom layer 322. As discussed herein, the reduced thickness portions 362*a*, 362*b* may be coupled or mated to each other when forming retention loop 336 to maintain a uniform thickness for bottom layer 322.

Figure 7B:
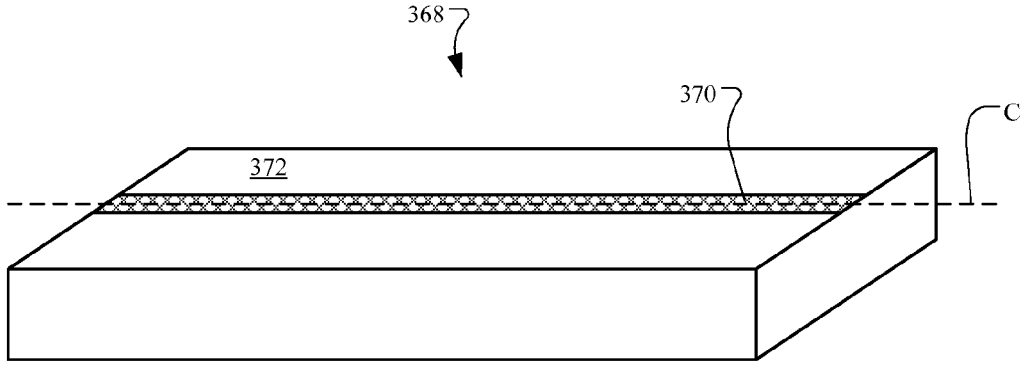
FIG. 7B shows an illustrative perspective view of a mandrel utilized in forming a retention loop, according to embodiments.

FIG. 7B depicts an illustrative perspective view of a mandrel 368 used in the process of forming retention loop 336, as discussed herein. As shown in FIG. 7B, mandrel 368 may have a substantially rectangular geometry, similar to the desired geometry of retention loop 336 (see, FIG. 7K). An adhesive strip 370 may be positioned along a center (C) of a top surface 372 of mandrel 368. Adhesive strip 370 may be any suitable adhesive, such as double-sided tape, that may adhere bottom layer 322 to mandrel 368 when forming retention loop 336, as discussed herein. Mandrel 368 may provide a rigid structure to bottom layer 322, and other layers of material, when forming retention loop 336.

Figure 7C:
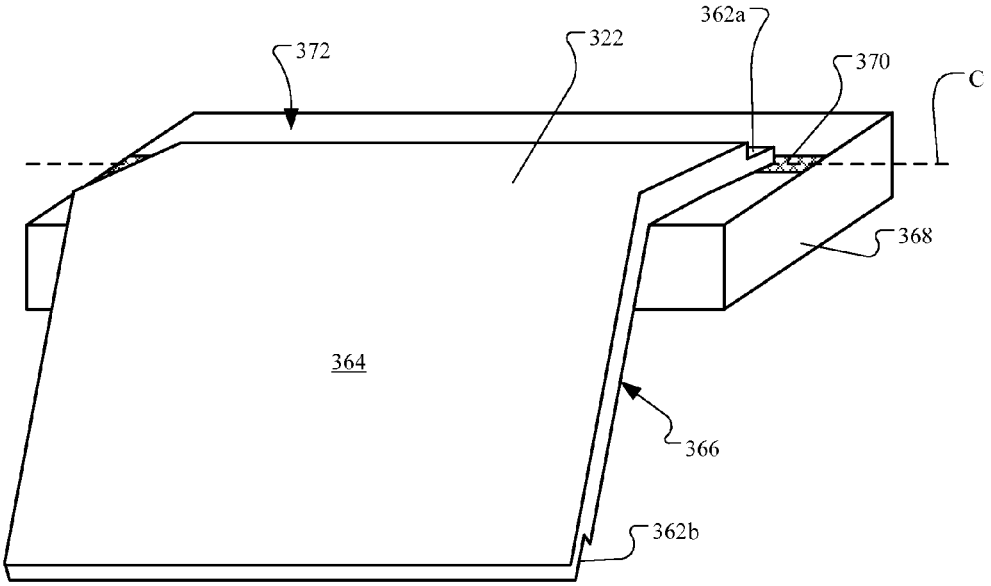
FIGS. 7C and 7D show illustrative perspective views of the bottom layer of FIG. 7A and the mandrel of FIG. 7B undergoing processes for forming a retention loop, according to embodiments.
Figure 7D:
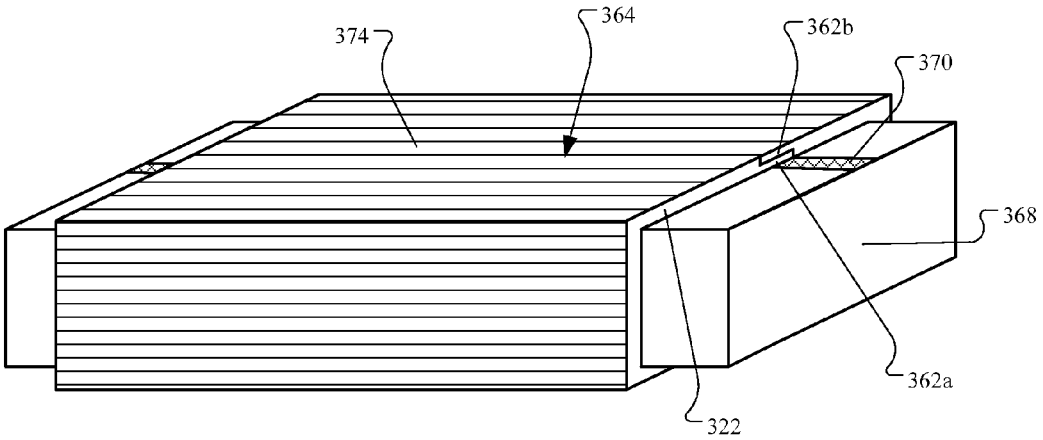

FIGS. 7C and 7D depict bottom layer 322 being coupled to mandrel 368. In a non-limiting example, when forming retention loop 336 (see, FIG. 7K), bottom layer 322, having reduced thickness portions 362*a*, 362*b*, may be coupled to and/or wrapped around mandrel 368. As shown in FIGS. 7C and 7D, second surface 366 of bottom layer 122 may contact mandrel 368. Additionally, the first end of bottom layer 322 having reduced thickness portion 362*a* may be coupled to and/or adhered to adhesive strip 370 of mandrel 368 on second surface 366. By adhering bottom layer 322 to mandrel 368, bottom layer 322 may remain substantially stationary on mandrel 368 during the wrapping process.

As shown in FIG. 7D, and as discussed herein, second reduced thickness portion 362*b* may be coupled to and/or mated with first reduced thickness portion 362*a*. In a non-limiting example, when bottom layer 322 is wrapped completely around mandrel 368, second reduced thickness portion 362*b* may be coupled to and/or mated with first reduced thickness portion 362*a* to form a continuous loop of material around mandrel 368. As shown in FIG. 7D, by mating and/or coupling the reduced thickness portions 362*a*, 362*b*, bottom layer 322 may have a uniform thickness after being wrapped around and/or coupled to mandrel 368. Second reduced thickness portion 362*b* may be coupled to and/or mated with first reduced thickness portion 362*a* using any suitable bonding agent or technique including, but not limited to, adhesive, adhesive tape, melting, and the like.

Additionally as shown in FIG. 7D, an adhesive 374 may be applied to first surface 364 of bottom layer 322. Adhesive 374 may cover a portion or an entirety of first surface 364 of bottom layer 322. Adhesive 374 may be any suitable bonding agent used to couple an additional layer of material to bottom layer 122, as discussed herein.

Figure 7E:
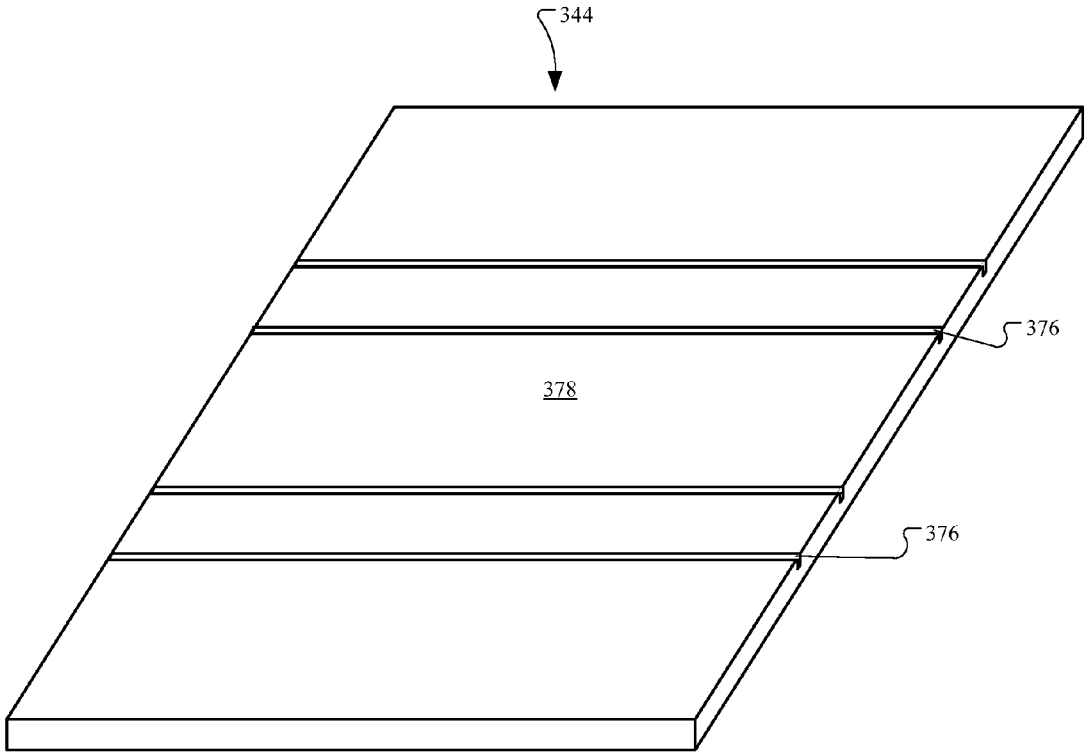
FIG. 7E shows an illustrative perspective view of a tensile member utilized in forming a retention loop, according to embodiments.

FIG. 7E depicts an illustrative perspective view of tensile member 344 utilized in the formation of retention loop 336 (see, FIG. 7K), as discussed herein. Tensile member 344 may be formed from a partially-rigid, non-woven material, such as polyester or urethane. Tensile member 344 may provide structural support, rigidity shape, and/or geometry to retention loop 336, as discussed herein.

Figure 7F:
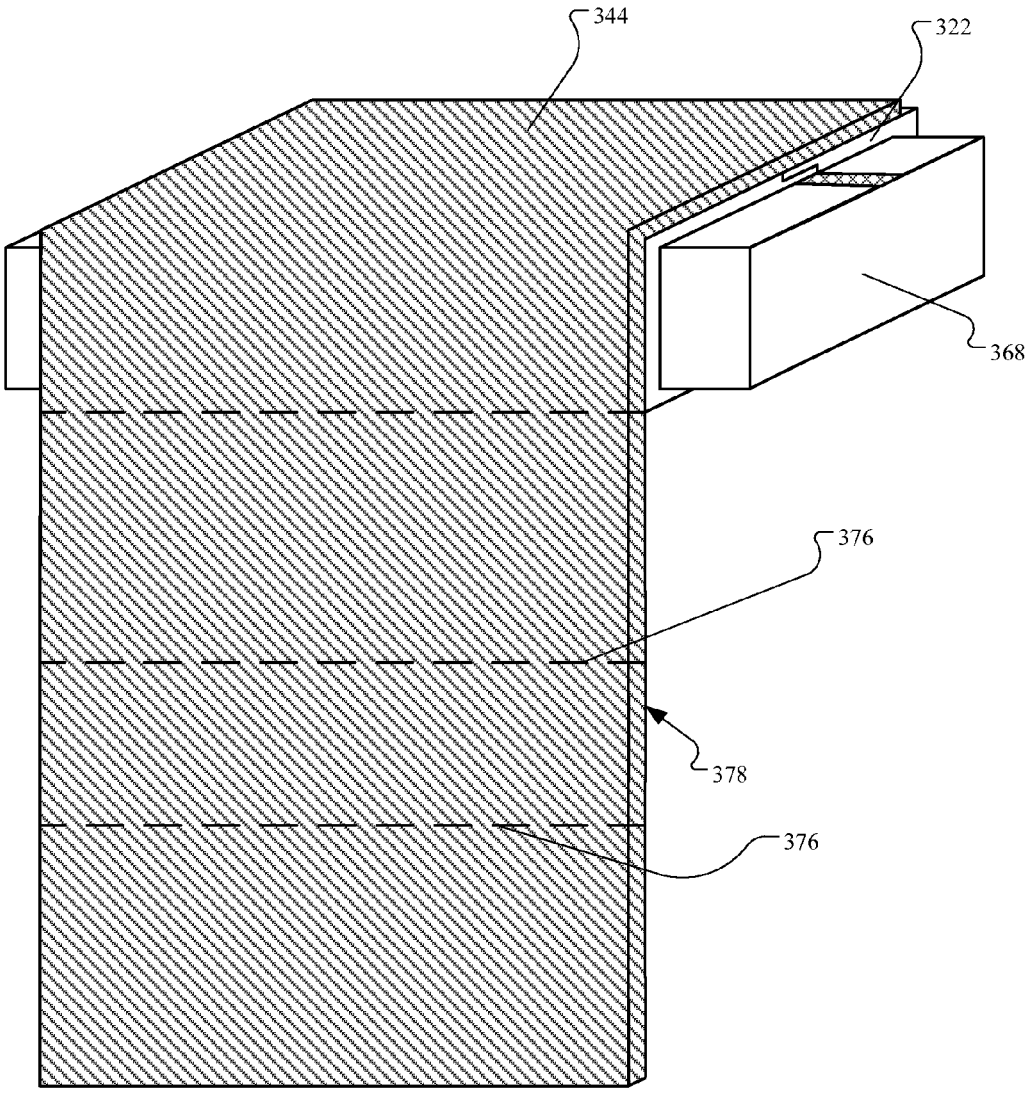
FIGS. 7F and 7G shows an illustrative perspective view of the bottom layer FIG. 7A, the mandrel of FIG. 7B, and the tensile member of FIG. 7E undergoing processes for forming a retention loop, according to embodiments.

As a result of the structurally rigid properties of tensile member 344, a plurality of creases or score lines 376 may be formed partially through a contact surface 378 of tensile member 344 to aid in the flexibility of tensile member 344. Score lines 376 may be formed in predetermined areas or portions of tensile member 344, to allow tensile member 344 to wrap around mandrel 368 and/or bottom layer 322. In a non-limiting example shown in FIGS. 7F and 7G, contact surface 378 of tensile member 344 may be coupled to bottom layer 322 using adhesive 374 applied to first surface 364 (see, FIG. 7D). Additionally, as shown in FIGS. 7F and 7G, score lines 376 (shown in phantom) formed partially though contact surface 378, may be formed in predetermined positions to align with the corners, bends, and/or folds in mandrel 368 and/or bottom layer 322.

Figure 7G:
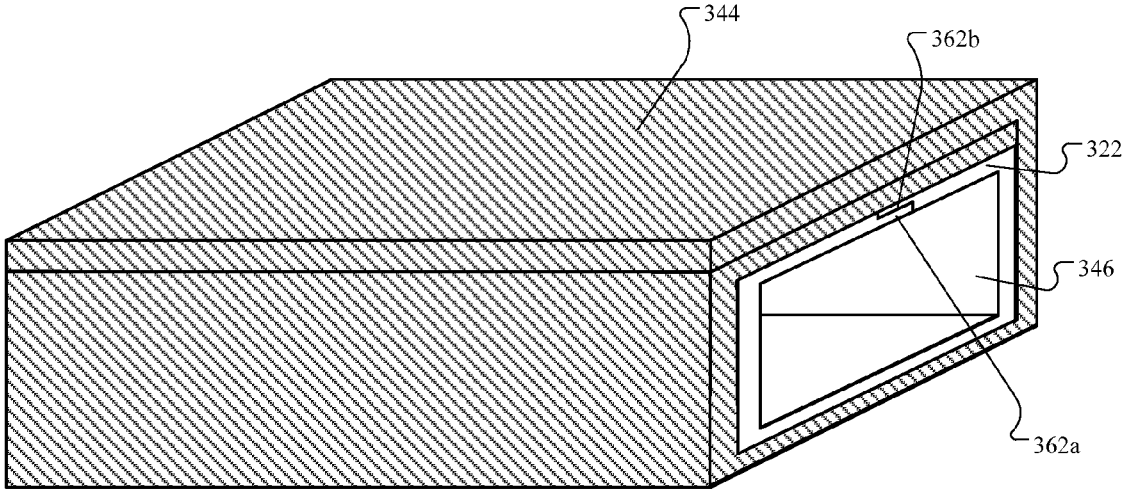

Additionally, as shown in FIG. 7G, tensile member 344 may be "double wrapped" over the reduced thickness portions 362*a*, 362*b* of bottom layer 322. In a non-limiting example shown in FIG. 7G, two layers of tensile member 344 may be positioned above reduced thickness portions 362*a*, 362*b* of bottom layer 322. The double wrapping of tensile member 344 may be a result of an extra length of material forming tensile member 344 being wrapped around the portion of bottom layer 322 having reduced thickness portions 362*a*, 362*b* a second time. As discussed herein, the double wrapping of tensile member 344 over bottom layer 322 may aid in maintaining an overall uniform or symmetric thickness of retention loop 336.

Figure 7H:
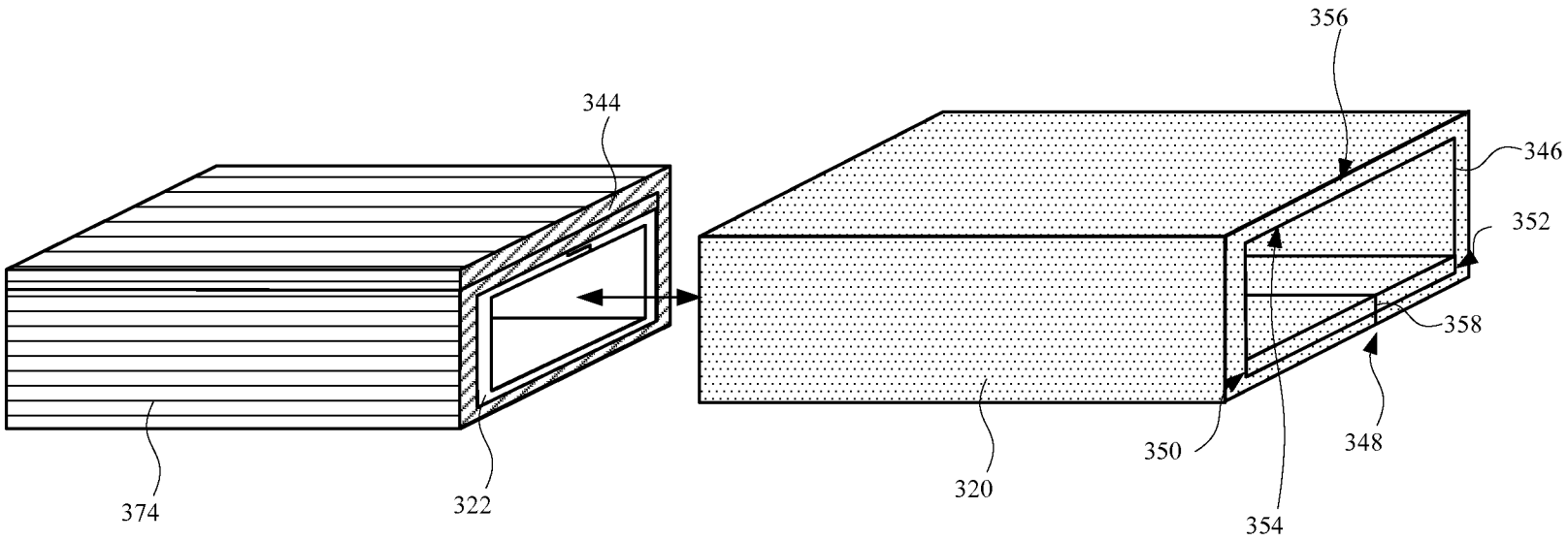
FIGS. 7H-7J show an illustrative perspective view of the bottom layer FIG. 7A, the mandrel of FIG. 7B, the tensile member of FIG. 7E, and a top layer undergoing processes for forming a retention loop, according to embodiments.
Figure 7I:
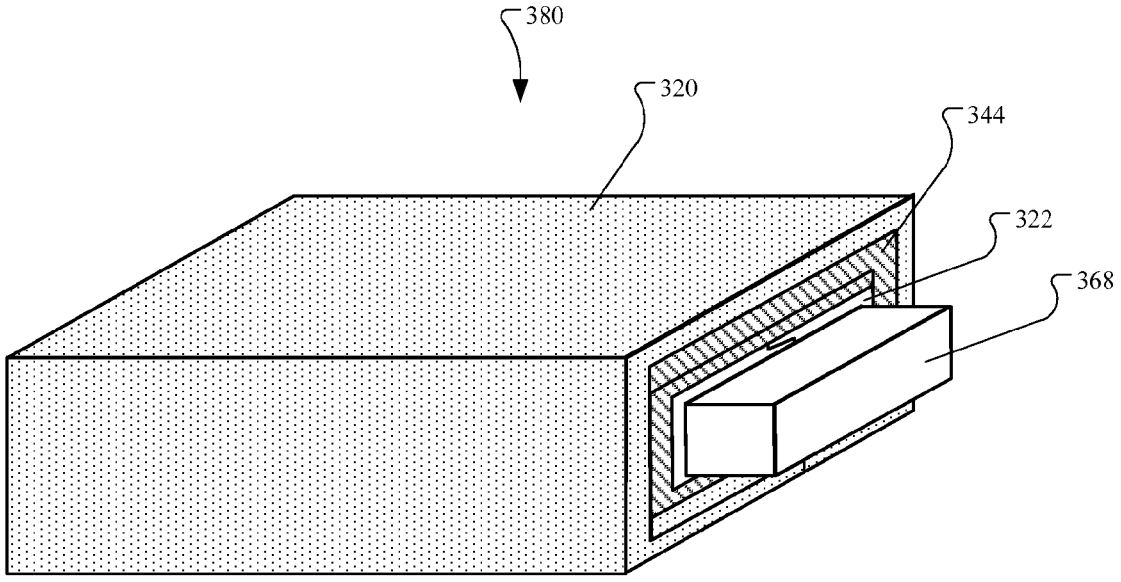

FIGS. 7H and 7I, depict a top layer 320 of material being coupled to and/or positioned around tensile member 344 and bottom layer 322. Top layer 320 may be formed from a distinct piece of material, such as leather, when forming retention loop 336 (see, FIG. 7K), as discussed herein. Also shown in FIG. 7H, top layer 320 may include a single piece of material that may be sewn together. That is, top layer 320 may be formed by stitching a portion of the material adjacent ends 350, 352 using thread 358. As shown in FIG. 7H, the stitching of top layer 320 may formed a visible seam 348 on exterior surface 356 of top layer 320. The formation of top layer 320 having seam 348 may be substantially similar to the processes discussed herein with respect to FIGS. 6A-6C.

However, distinct from the process discussed with respect to FIGS. 6A-6C, ends 350, 352 of top layer 320 may be positioned within opening 346 of top layer 320. As shown in FIG. 7H, a portion of material including ends 350, 352 may be positioned within opening 346, and may be folded down and/or glued to interior surface 354 of top layer 320. As a result, top layer 320 may include a greater thickness on the portion including seam 348, than adjacent portions. As discussed herein, the uniform and/or symmetrical thickness of retention loop 336 may be maintained as a result of the layered configuration of bottom layer 322, tensile member 344, and/or top layer 320.

As shown in FIGS. 7H and 7I, tensile member 344 and bottom layer 322 may be removed from mandrel 368, prior to being inserted within opening 346 and/or being coupled top layer 320. By removing tensile member 344 and bottom layer 322 from mandrel 368, tensile member 344 and bottom layer 322 may be slightly deformed to be more easily inserted into opening 346 formed in top layer 320. To aid in the coupling and/or bonding of top layer 320 to tensile member 344 and/or bottom layer 322, tensile member 344 may be partially or completely covered with an adhesive 374, as shown in FIG. 7H.

As shown in FIGS. 7H and 7I, opposite sides or portions of the assembly 380 including top layer 320, tensile member 344 and bottom layer 322 may include equal thicknesses. In a non-limiting example, and as discussed herein, top layer 320 may include a double layer of material on a side or portion of the assembly 380 including seam 348. As a result, when tensile member 344 and bottom layer 322 are inserted into opening 346 to be coupled to top layer 320, the side or portion of the assembly 380 including seam 348 in top layer 320 may include four (4) layers: two (2) layers of material of top layer 320, one (1) layer of material for tensile member 344, and one (1) layer of material for bottom layer 322. In the non-limiting example, the opposite side or portion of assembly 380 may include the double wrapped or two layers of tensile member 344. As a result, the side or portion of the assembly 380 opposite the side or portion including the seam 348 may include four (4) layers as well: two (2) layers of material of tensile member 344, one (1) layer of material for top layer 320, and one (1) layer of material for bottom layer 322.

Additionally shown in FIG. 7I, subsequent to top layer 320 being coupled to tensile member 344 and bottom layer 322 to form assembly 380, assembly 380 may be repositioned on mandrel 368. Mandrel 368 in FIG. 7I may be the same mandrel 368 depicted in FIGS. 7B-7D and 7F, or may be a distinct mandrel. Assembly 380 may be repositioned on mandrel 368 to heat the assembly 380 and set the adhesive 374 used to bond each layer together. In a non-limiting example, mandrel 368 may be heated to set adhesive 374 positioned between bottom layer 322 and tensile member 344 (see, FIG. 7D), and set adhesive 374 positioned between tensile member 344 and top layer 320 (see, FIG. 7H) to strength the bond between the respective, adhered layers. By using heated mandrel 368, the adhesive 374 may be set from the inside, rather than applying heat to the assembly from the exterior. By setting the adhesive by applying heat from the inside using mandrel 368, the risk of cosmetic damage to the exterior of the assembly 380 may be substantially minimized or eliminated when forming retention loop 336. Additionally, by setting the adhesive on heated mandrel 368, assembly 380 may take the desired shape and/or geometry of mandrel 368.

Figure 7J:
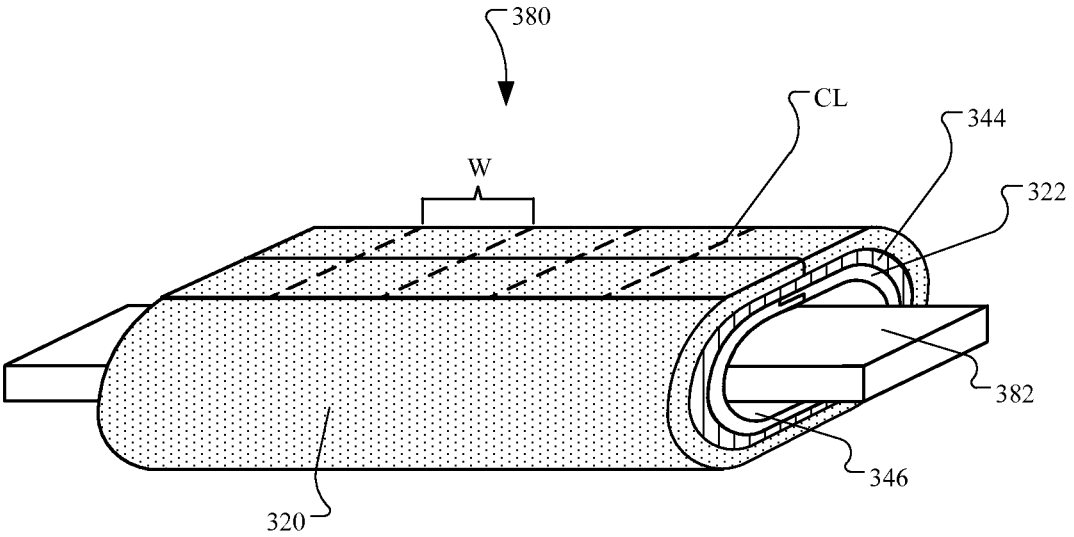

FIG. 7J depicts a perspective view of assembly 380 positioned on a sacrificial member 382. Sacrificial member 382 may be positioned through the opening formed in assembly 380. As shown in FIG. 7J, sacrificial member 382 may be wider than opening 346 of assembly 380. As a result, by inserting sacrificial member 382 through opening 346 of assembly 380, assembly 380 may be temporarily flattened, stretched, and/or deformed. Sacrificial member 382 may be formed from a substantially rigid material, such as nylon, that may deform assembly 380 when inserted therein, and may be cut during a cutting process, as discussed herein.

The flattening or stretching of assembly 380 may aid in a cutting process of assembly 380. In a non-limiting example, subsequent to assembly 380 being flattened or stretched by inserting sacrificial member 382 therein, assembly 380 may be cut into a plurality of retention loops 336 (see, FIG. 7K) having a desired width (W). As shown in FIG. 7J, assembly 380 may be cut along cut lines (CL) to form a plurality of retention loops 336. In a non-limiting example, assembly 380 may be cut along cut lines (CL) using a die cut process, where a blade cuts completely though assembly 380 and sacrificial member 382 to form retention loops 336. In another non-limiting example, the cutting process may include the use of a circular belt cutting tool to cut assembly 380 along cut lines (CL). The circular belt cutting tool may cut assembly 380 by rotating a cutting blade completely around stationary assembly 380, by rotating assembly 380 while contacting a stationary cutting blade, or any combination of the two processes.

Figure 7K:
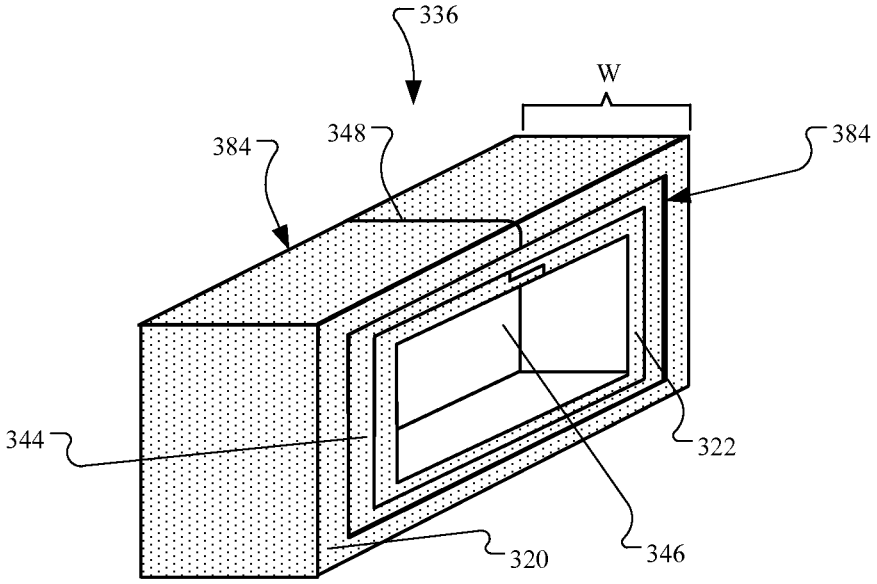
FIG. 7K shows an illustrative perspective view of a retention loop for a wearable band, according to embodiments.

FIG. 7K depicts an illustrative perspective view of a single retention loop 336 formed from assembly 380 (see, FIG. 7J). Retention loop 336 may undergo further processing prior to being utilized with a wearable band 110 of an electronic device 100, as discussed herein with respect to FIGS. 1 and 2. In a non-limiting example, exposed ends 384 of retention loop 336 may undergo a sanding process. The sanding process may remove any undesirable aesthetic irregularities of retention loop 336 that may be formed during the cutting process, discussed herein. The material of the layers (e.g., top layer 320, tensile member 344, bottom layer 322) may fray, be unevenly cut, tear and/or have a rough edge at exposed ends 384 as a result of the cutting process. A sanding process may be performed on the exposed ends 384 to substantially minimize, and/or eliminate the aesthetic irregularities (fray, rough edge, and so on), and may form substantially uniform exposed ends 384 for retention loop 336.

Subsequent to the sanding process, exposed ends 384 may be painted. As shown in FIG. 7K, and compared to FIG. 7J, exposed ends 384 of retention loop 336 may be painted a color similar to top layer 320 of retention loop 336. In a non-limiting example, all layers of retention loop 336, including top layer 320, tensile member 344 and bottom layer 322, may be painted at exposed ends 384 to make retention loop 336 uniform in color. Additionally, the painting of exposed ends 384 may depict retention loop 336 as being formed from a single material, which may be aesthetically appealing to a user of a wearable band including retention loop 336.

Figure 8:
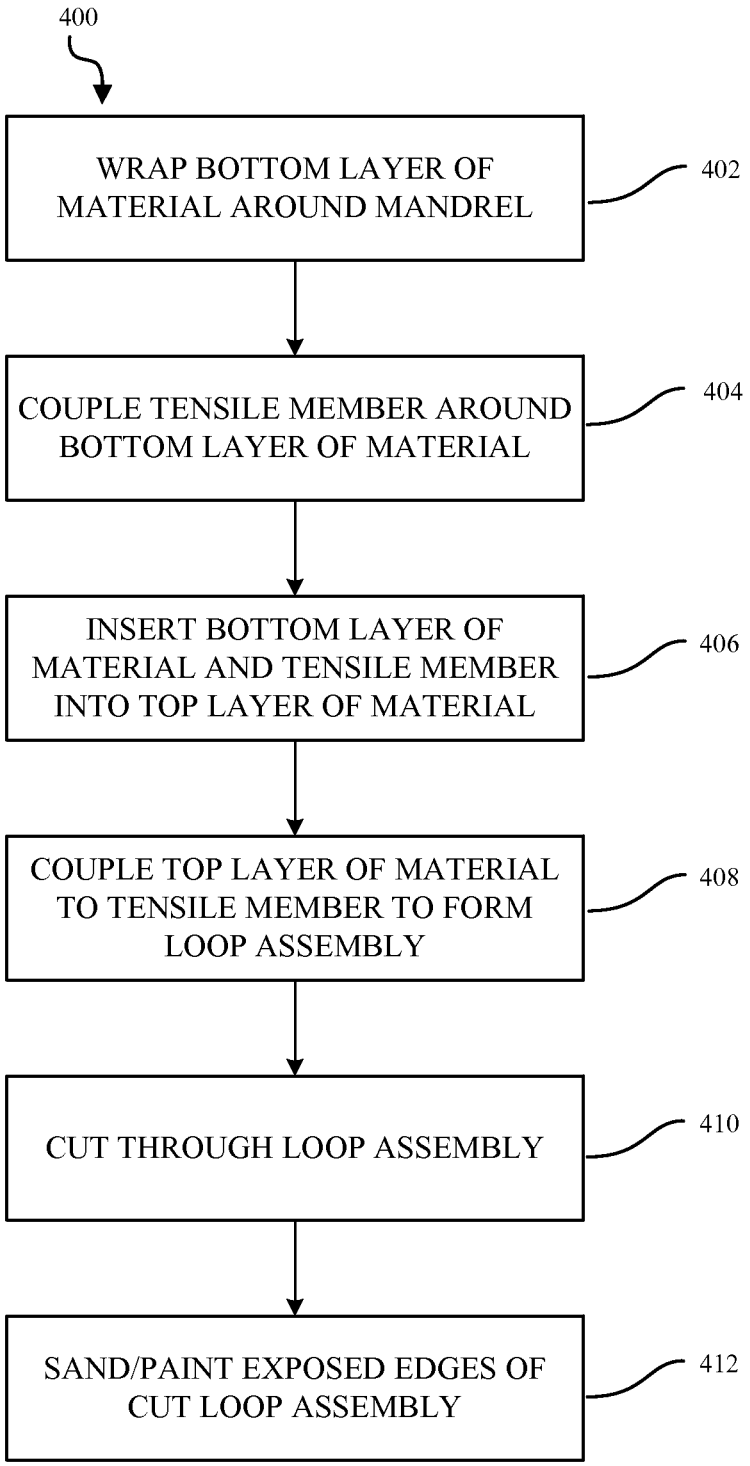
FIG. 8 shows a flow chart illustrating a method of forming a plurality of retention loops for a wearable band. This method may form the retention loops as shown in FIGS. 7A-7K.

FIG. 8 depicts an example process for forming a plurality of retention loops for a wearable band. That is, FIG. 8 is a flowchart depicting one example process 400 for forming a plurality of retention loops for a wearable band. In some cases, the process may be used to form one or more retention loops, as discussed above with respect to FIGS. 7A-7J.

In operation 402 a bottom layer of material may be wrapped around and/or coupled to a mandrel to form an inner loop. In operation 404, a tensile member may be coupled to and/or wrapped around the bottom layer of the material wrapped around and/or coupled to the mandrel. In operation 406, the bottom layer, and the tensile member coupled to the bottom layer may be removed from the mandrel and may be inserted into an opening formed in a top layer of material. The top layer of material having the opening may form an outer loop. In operation 408, the top layer of material may be coupled to and/or positioned around the tensile member, and the bottom layer of material, to form a loop assembly. In operation 410, the loop assembly, including the top layer of material, the tensile member and the bottom layer of material, may be cut or diced into a plurality of retention loops. In operation 412, the exposed edges of each individually cut retention loop may undergo a sanding process, and/or a painting process.

FIGS. 9A-9M depict a process of forming a retention loop 536 for a wearable band 110 (see, FIG. 2). In non-limiting embodiments, FIGS. 9A-9M show a process of formation of the retention loop 536 including a single piece of material 586, and tensile member 544. Distinct from the process discussed herein with respect to FIGS. 7A-7K where a plurality of retention loops 336 are formed from an assembly 380, the process discussed herein with respect to FIGS. 9A-9M depict a single or individual retention loop 536 being formed.

Figure 9A:
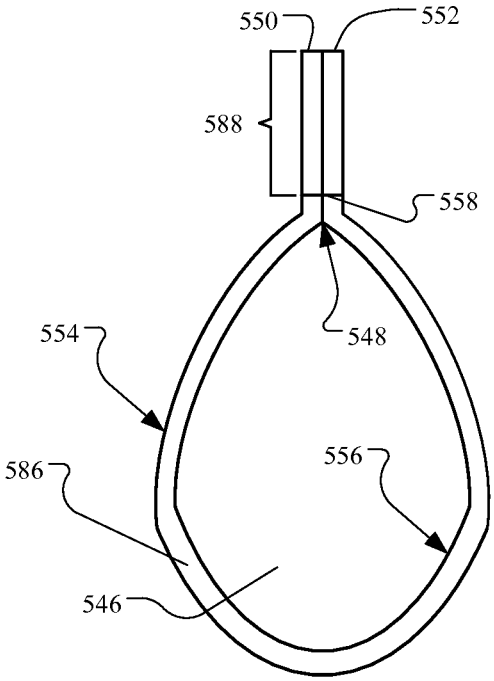
FIG. 9A shows an illustrative front view of a single piece of material utilized in forming a retention loop, according to further embodiments.
Figure 9B:
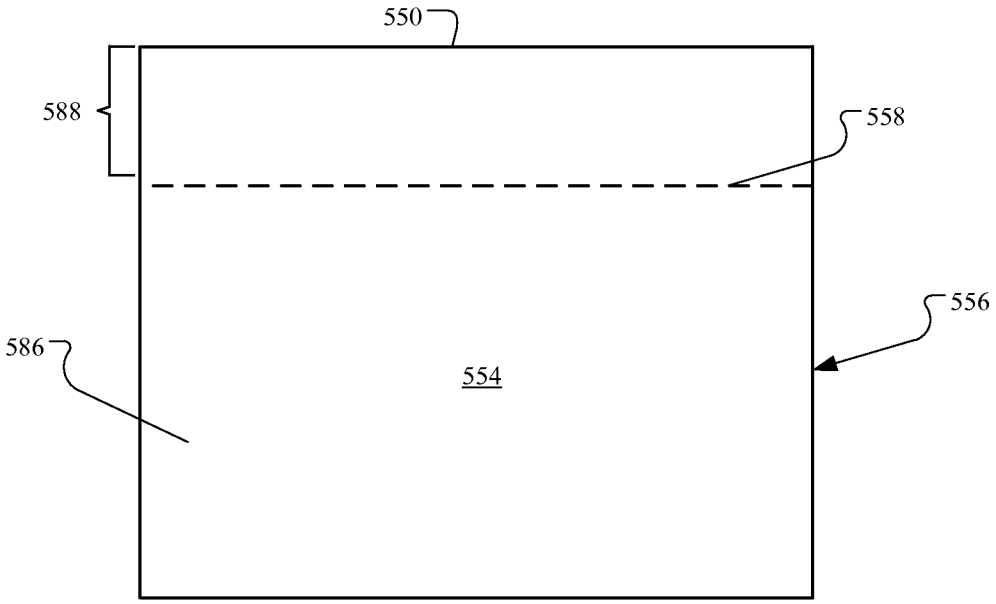
FIG. 9B shows an illustrative side view of the single piece of material of FIG. 9A, according to further embodiments.

FIGS. 9A and 9B depict front and side views, respectively, of a single piece of material 586 (hereafter, "material 586") utilized in forming retention loop 536. Material 586 may be substantially similar to top layer 320 and/or bottom layer 322, as discussed herein with respect to FIGS. 7A-7K. In a non-limiting example, material 586 may be formed from leather. As shown in FIGS. 9A and 9B, ends 550, 552 of material 586 may be positioned adjacent each other, and a stitch may be formed adjacent ends 550, 552 using thread 558. The portion of material 586 positioned between thread 558 and ends 550, 552 may be selvedge material 588. The stitch formed using thread 558 may form opening 546 in material 586, as shown in FIG. 9A.

Additionally shown in FIG. 9A, and similarly discussed herein with respect to FIG. 6B, thread 558 may form a stitch on material 586 that may be inside out. In a non-limiting example shown in FIG. 9A, thread may be formed through material 586 while interior surface 554 is exposed and exterior surface 556 is formed within and/or adjacent opening 546. As discussed below in detail, at least a portion of material 586 may be turned right side-in, or reversed to expose exterior surface 556 when forming retention loop 536.

Figure 9C:
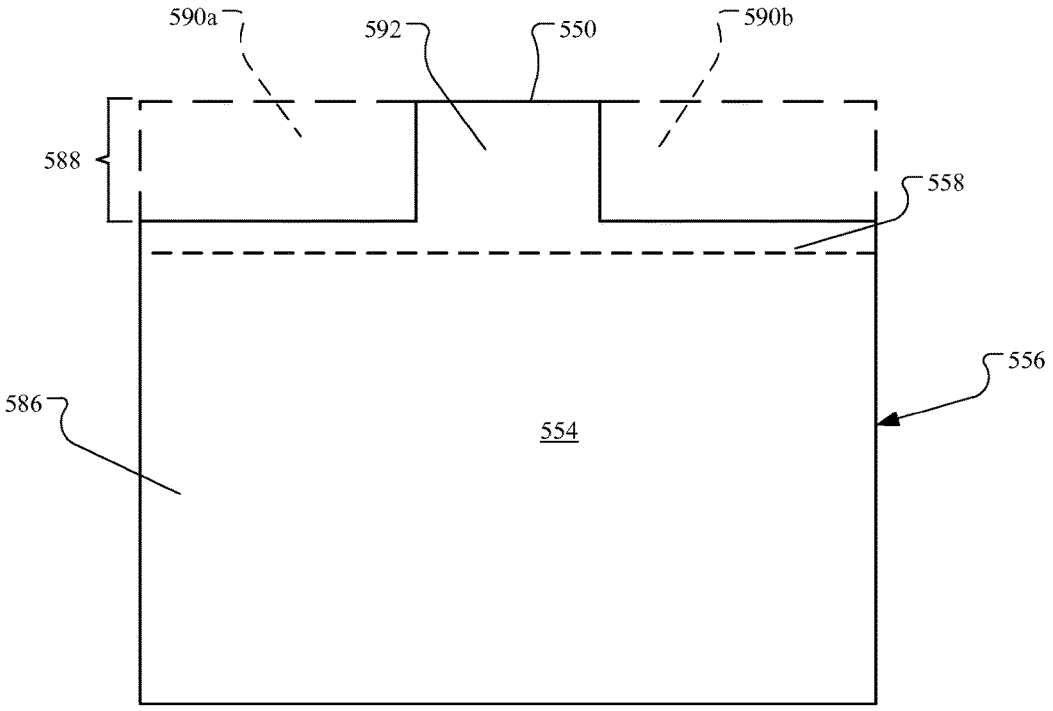
FIG. 9C shows an illustrative side view of the single piece of material of FIGS. 9A and 9B undergoing processes for forming a retention loop, according to further embodiments.

FIG. 9C depicts a side view of material 586 undergoing another process of forming retention loop 536. As shown in FIG. 9C, extra selvedge portions 590*a*, 590*b* of selvedge material 588 may be removed from material 586. In a non-limiting example, extra selvedge portions 590*a*, 590*b* may be removed on the selvedge material 588 to form a centralized selvedge portion 592 of material 586. As show in FIG. 9C, centralized selvedge portion 592 may be a portion of selvedge material 588 remaining above thread 558 of material 586 when forming retention loop 536. Additionally, and as discussed herein, centralized selvedge portion 592 may define an outer portion of material 586 that may be exposed when retention loop 536 is formed.

Figure 9D:
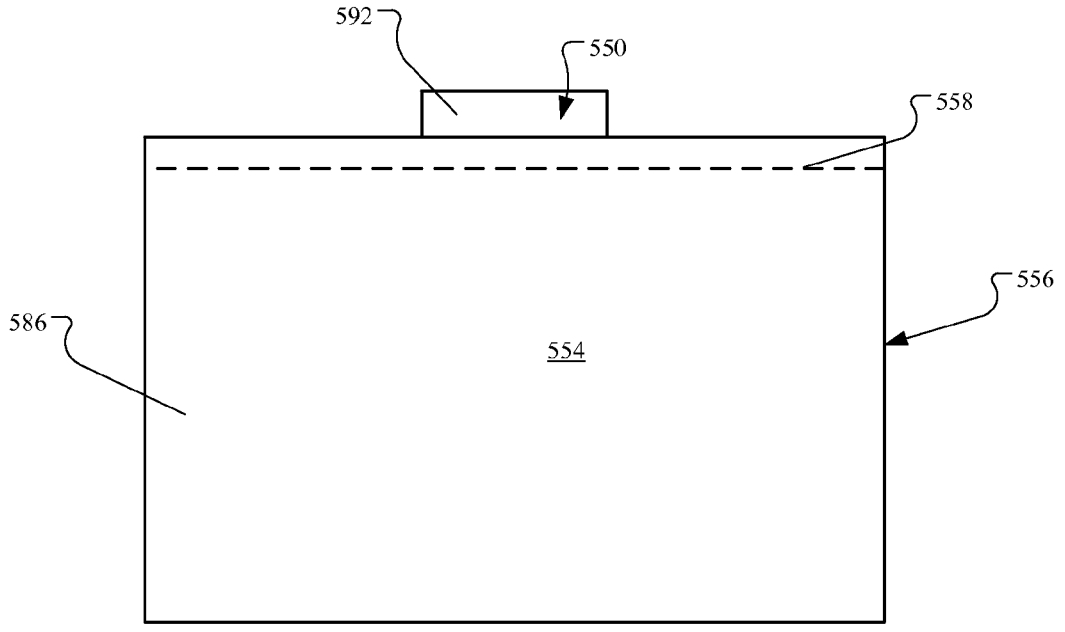
FIG. 9D shows an illustrative side view of the single piece of material of FIGS. 9A and 9B undergoing processes for forming a retention loop, according to further embodiments.
Figure 9E:
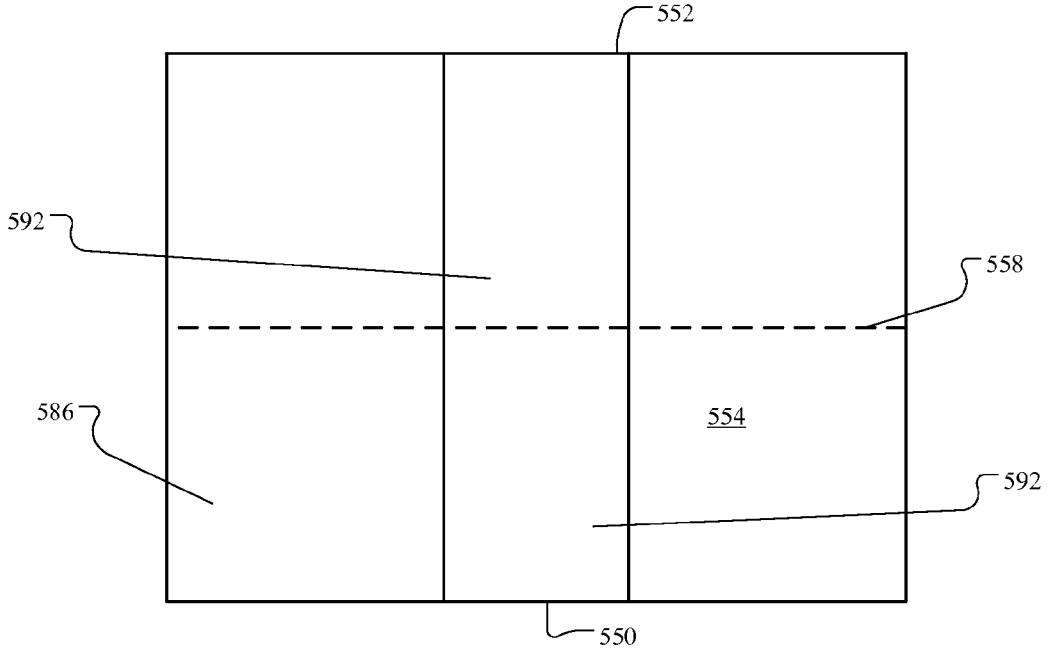
FIG. 9E shows an illustrative top view of the single piece of material of FIG. 9D, according to embodiments.

FIGS. 9D and 9E depict front and top views, respectively, of material 586. After the removal process of extra selvedge portions 590*a*, 590*b*, centralized selvedge portion 592 of material 586 may contact interior surface 554. In a non-limiting example, centralized selvedge portion 592 may be folded down and coupled to interior surface 554 of material 586. As shown in FIG. 9E, centralized selvedge portion 592 may folded along the stitched formed by thread 558, such that ends 550, 552 of selvedge portion 592 are positioned opposite one another. Centralized selvedge portion 592 of material 586 may be coupled to interior surface 554 of material 586 using any suitable bonding agent or technique including, but not limited to, adhesive, adhesive tape, melting, and the like.

Figure 9F:
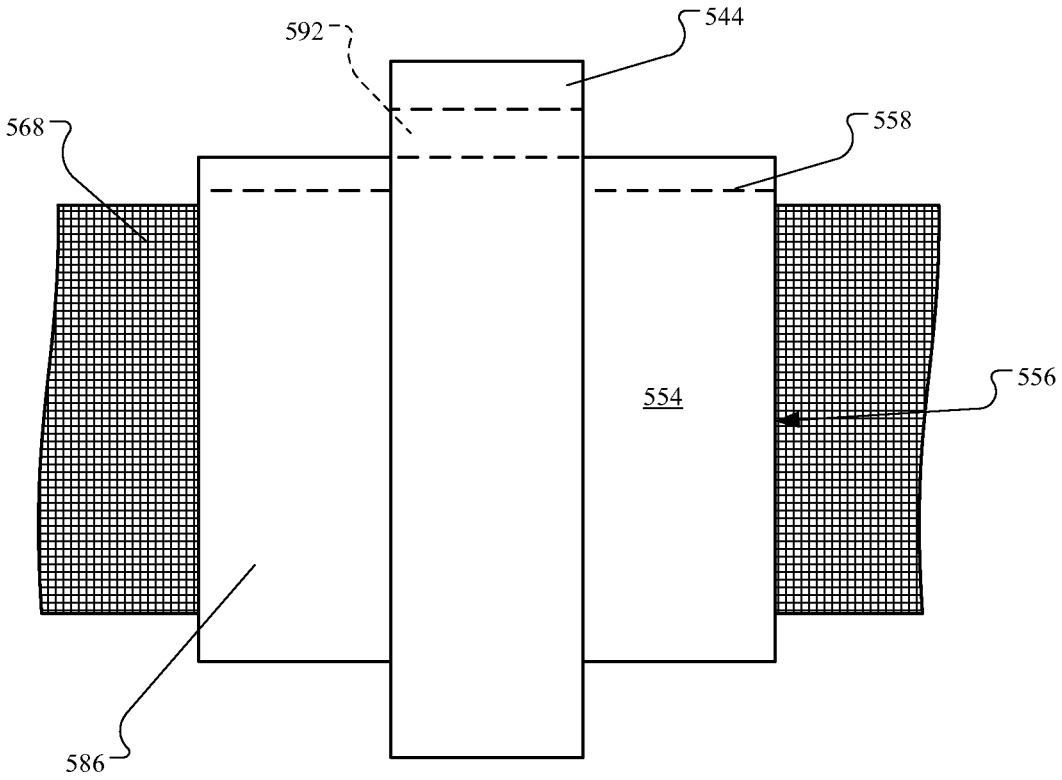
FIG. 9F shows an illustrative side view of the single piece of material of FIG. 9D undergoing processes for forming a retention loop, according to further embodiments.
Figure 9G:
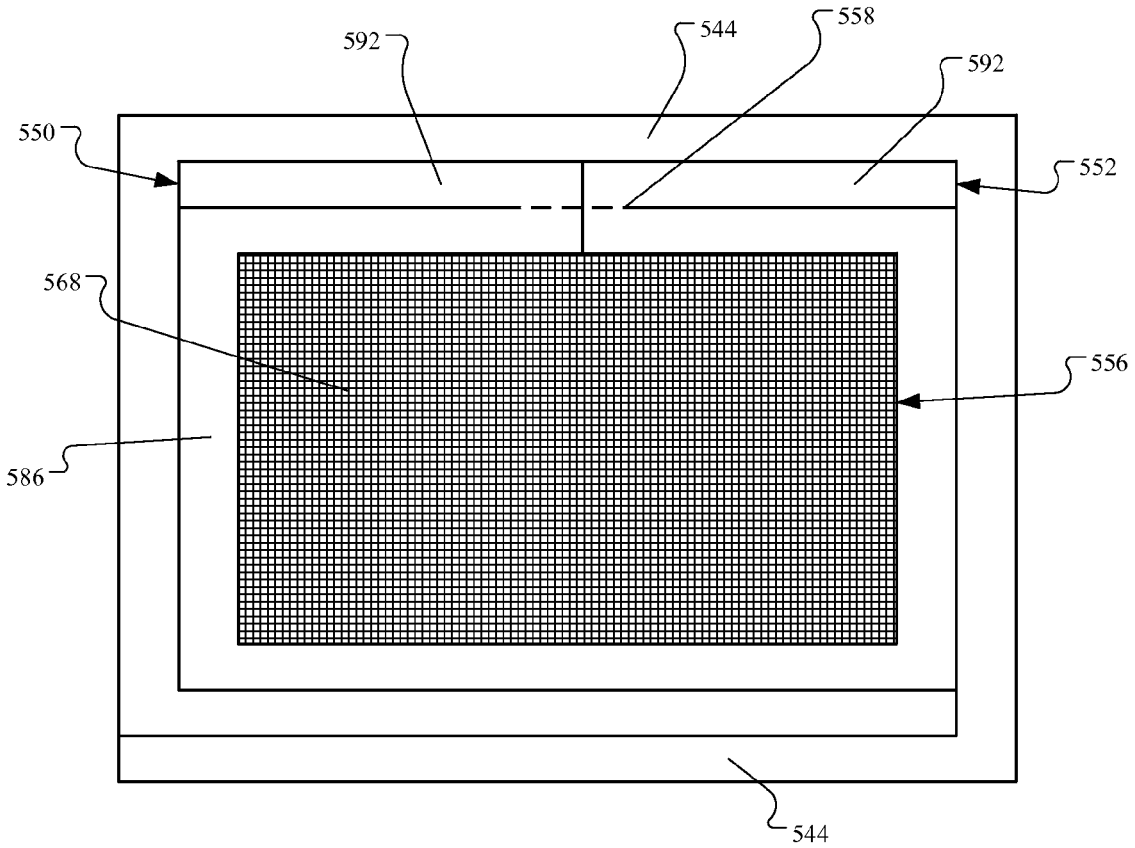
FIG. 9G shows an illustrative front view of the single piece of material of FIG. 9F, according to embodiments.
Figure 9H:
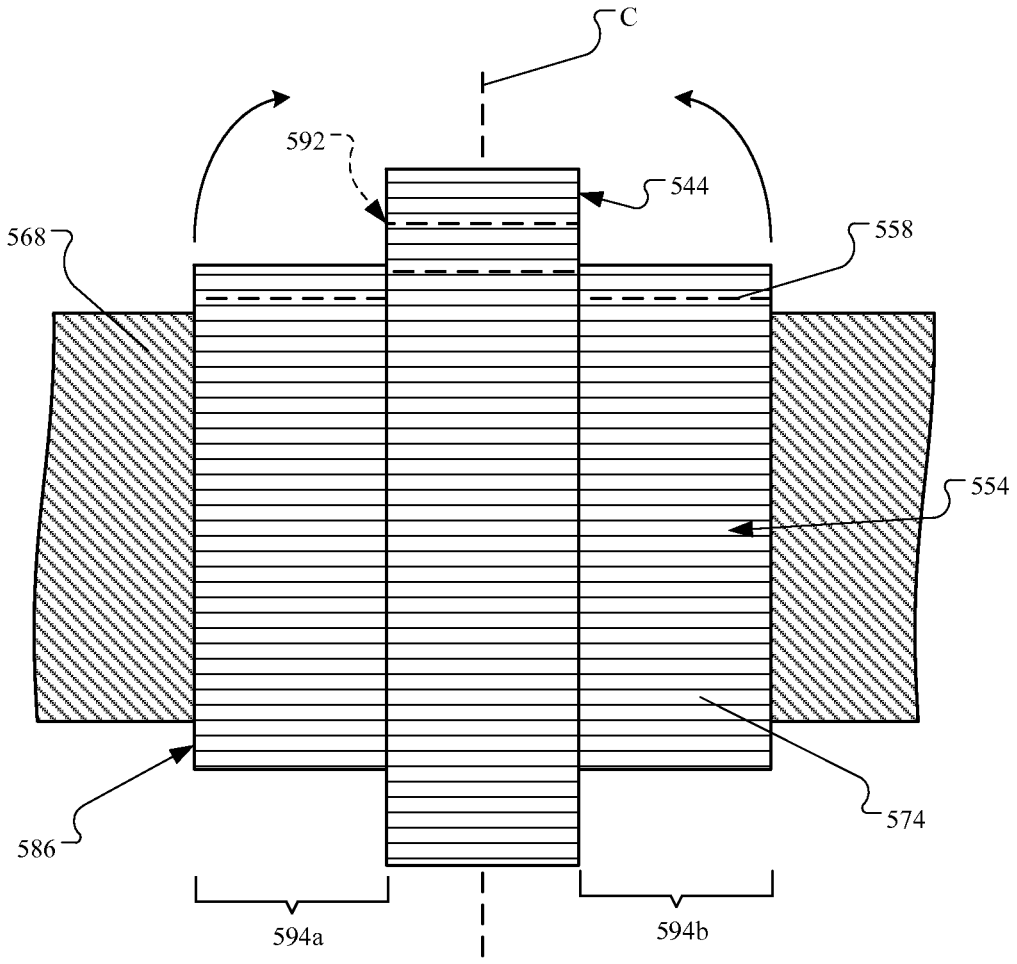
FIGS. 9H-9J show illustrative side views of the single piece of material of FIG. 9F undergoing processes for forming a retention loop, according to further embodiments.
Figure 9I:
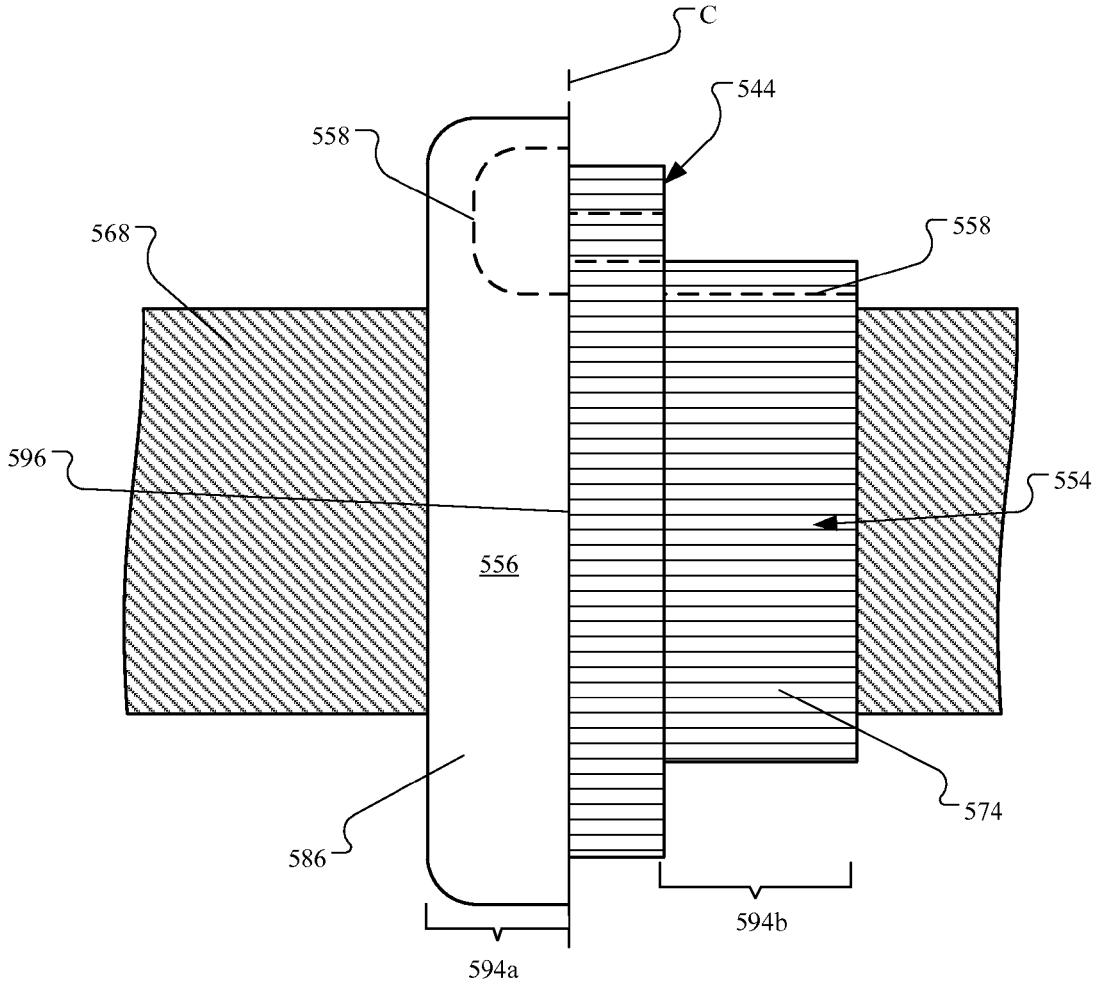
Figure 9J:
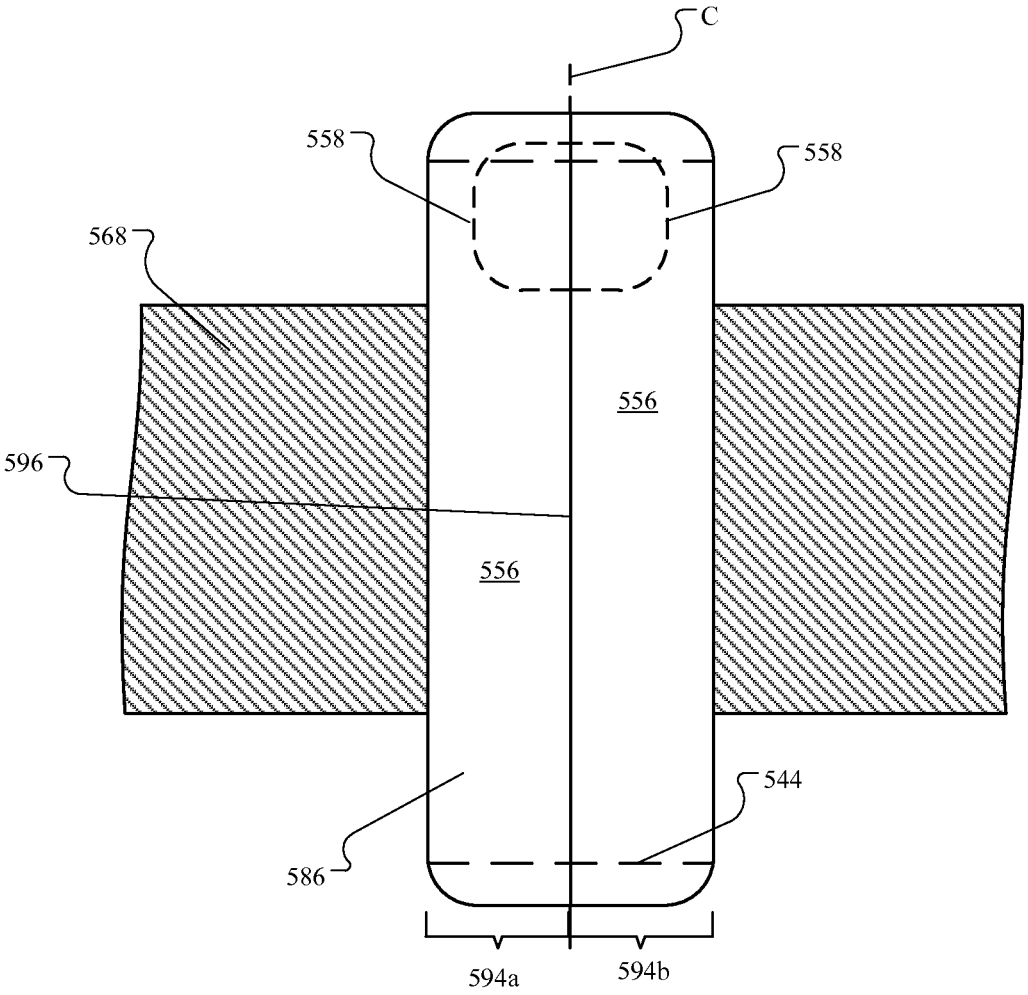
Figure 9K:
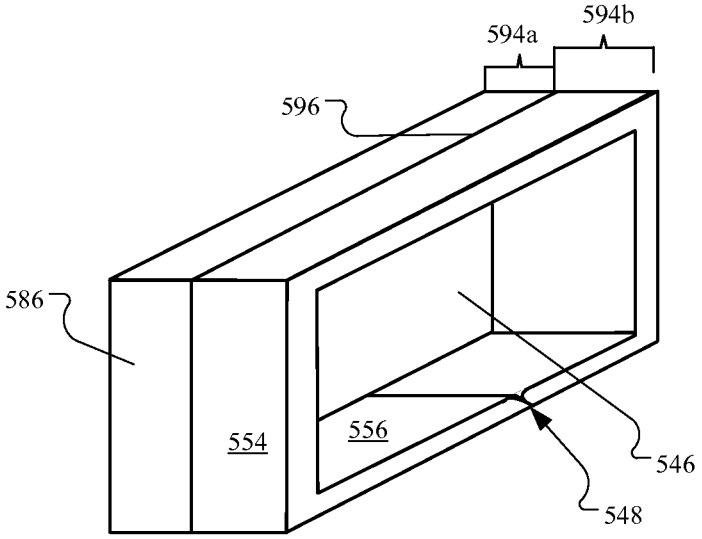
FIGS. 9K and 9L show illustrative perspective views of the single piece of material of FIG. 9J undergoing processes for forming a retention loop, according to further embodiments.
Figure 9L:
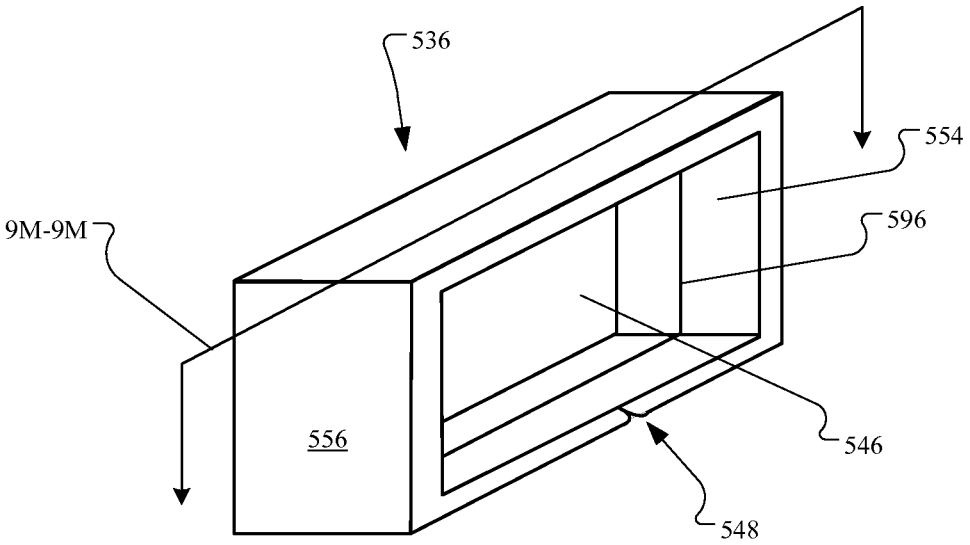

FIGS. 9F and 9G show front and side views, respectively, of material 586 undergoing additional processes for forming retention loop 536 (see, FIG. 9L). As shown in FIGS. 9F and 9G, material 586 may be placed on a mandrel 1784. As similarly discussed herein with respect to FIG. 7B, mandrel 1784 may have a substantially rectangular geometry, similar to the desired geometry of retention loop 536. Additionally, mandrel 1784 may provide structural support to material 586 when undergoing processes for forming retention loop 536.

Additionally as shown in FIGS. 9F and 9G, a subsequent process of wrapping tensile member 544 around material 586 may be depicted. In a non-limiting example, tensile member 544 may include a width substantially equal to the width of centralized selvedge portion 592 (shown in phantom) of material 586. As such, tensile member 544 may substantially cover centralized selvedge portion 592 of material 586.

As similarly discussed herein with respect to FIG. 7G, tensile member 544 may be double wrapped around a portion of material 586. In a non-limiting example shown in FIG. 9G, tensile member 544 may be double wrapped on a portion of material 586 opposite centralized selvedge portion 592. In the non-limiting, the portion of material 586 including centralized selvedge portion 592 may include three (3) layers after tensile member 544 is wrapped around material 586. The three layers include, one (1) layer of material 586 below thread 558, one (1) layer of folded, centralized selvedge portion 592, and one (1) layer of tensile member 544. In the non-limiting example shown in FIG. 9G, a portion of material 586 positioned opposite centralized selvedge portion 592 may also include three (3) layers: one (1) layer of material 586, and two (2) layers of tensile member 544. As similarly discussed herein, the double wrapping of tensile member 544 may aid in maintaining a uniform and/or symmetric thickness of retention loop 536 formed from material 586 and tensile member 544.

FIGS. 9H-9J show front views of material 586 and tensile member 544 undergoing further processes for forming retention loop 536 (see, FIG. 9K). Subsequent to the wrapping of tensile member 544 around material 586, an adhesive 1787 may be applied to a portion or substantially all of tensile member 544 and exposed, interior surface 554 of material 586. In a non-limiting example shown in FIG. 9H, both tensile member 544 and interior surface 554 of material 586 may be substantially covered with adhesive 1787. Adhesive 374 may be any suitable bonding agent used to bond foldable portions 594*a*, 594*b* of material 586 to itself and/or tensile member 544, as discussed herein.

As shown in FIGS. 9H-9J, two interior portions or foldable portions 594*a*, 594*b* of material 586 uncovered by tensile member 544 may be folded toward tensile member 544. In a non-limiting example, foldable portions 594*a*, 594*b* of material 1763 may be folded in respective directions, indicated by references arrows in FIG. 9H, toward a centerline (C) of tensile member 544 to be coupled to tensile member 544 and/or distinct portions of material 586 using adhesive 374. Foldable portions 594*a*, 594*b* of material 1763 may be folded or substantially rolled right side-in when being coupled to tensile member 544 to expose exterior surface 556 (see, FIGS. 9I and 9J). In a non-limiting example shown in FIG. 9I, a first foldable portion 594*a* may be folded toward centerline (C) and coupled to tensile member 544, while exposing a portion of exterior surface 556 of material 586. Interior surface 554 of material 586 may still be exposed on second foldable portion 594*b*, prior to folding of second foldable portion 594*b*. As discussed herein, two interior portions or foldable portions 594*a*, 594*b* of material 586 may be concealed, and/or positioned adjacent the opening 546 when forming retention loop 536.

FIG. 9J depicts second foldable portion 594*b* folded toward centerline (C) and coupled to tensile member 544 in a similar manner as first foldable portion 594*a*. As shown in FIG. 9J, a portion of exterior surface 556 of material 586 may be exposed on second foldable portion 594*b* coupled to tensile member 544. By folding and coupling both foldable portions 594*a*, 594*b* of material 586 to tensile member 544, a joint 596 may be formed between the foldable portions 594*a*, 594*b*. Although the foldable portions 594*a*, 594*b* of material 586 may touch or abut each other when coupled to tensile member 544, joint 596 may be formed there between as a result of foldable portions 594*a*, 594*b* being formed from two distinct portions of material 586.

Additionally, as shown in FIG. 9J, and discussed herein, thread 558 forming the stitch in material 586 may be substantially hidden as a result of coupling foldable portions 594*a*, 594*b* to tensile member 544. In a non-limiting example shown in FIG. 9J, thread 558 may fold with foldable portions 594*a*, 594*b*, such that a portion of the thread 558 may be positioned both below and about tensile member 544 (shown in phantom), but may be hidden from exterior surface 556 of material 586.

FIGS. 9K and 9L depict perspective views of material 586 and tensile member 544 undergoing additional processes for forming retention loop 536. As shown in FIG. 9K, material 586 is shown after foldable portions 594*a*, 594*b* are folded and coupled to tensile member 544 (see, FIG. 9H-J), and material 586 is removed from mandrel 1784. Joint 596 formed between foldable portions 594*a*, 594*b* of material 586 may be exposed and visible when material 586 is removed from mandrel 1784. Additionally, and as result of forming material 586 inside out, as discussed herein with respect to FIGS. 9A and 9B, interior surface 554 of material 586 may be the only surface visible when material 586 is removed from mandrel 1784. In a non-limiting example shown in FIG. 9K, interior surface 554 may be visible on the surface of material 586 including joint 596.

FIG. 9L depicts material 586 turned right side-in and/or reversed after being removed from mandrel 1784 to form retention loop 536. As shown in FIG. 9L and with comparison to FIG. 9K, material 586 may be turned right side-in, reversed and/or may be rolled, such that the portion of interior surface 554 including joint 596 is positioned within opening 546. Additionally, as shown in FIG. 9L, the portion of exterior surface 556 positioned within or adjacent opening 546 in FIG. 9K, may now be the exposed exterior surface of retention loop 536. Finally, as shown in FIG. 9L seam 548 formed on exterior surface 556 may be exposed on retention loop 536.

Figure 9M:
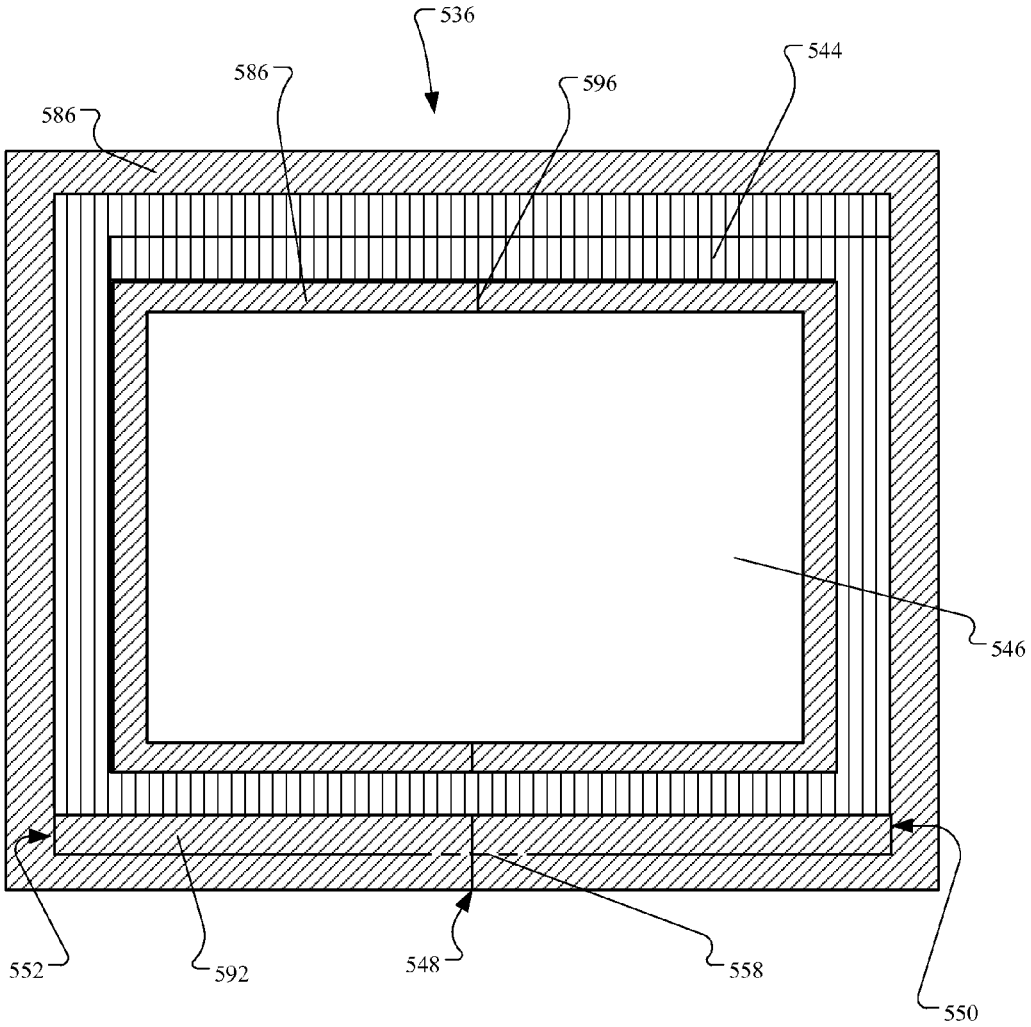
FIG. 9M shows an cross-section front view of a retention loop taken along line 9M-9M of FIG. 9L, according to embodiments.

FIG. 9M depicts a cross-section view of retention loop 536 taken along line 9M-9M in FIG. 9L. As shown in FIG. 9M joint 596 of retention loop 536 may be positioned within and/or adjacent opening 546, and may not be substantially exposed or visible by a user of a wearable band 110 (see, FIGS. 1 and 2) including retention loop 536. Additionally as shown in FIG. 9M, seam 548 formed in material 586 by forming a stitch using thread 558 may be the only feature exposed on exterior surface 556 of retention loop 536. The remainder of retention loop 536 may appear seamless to a user of wearable band 110.

Figure 10:
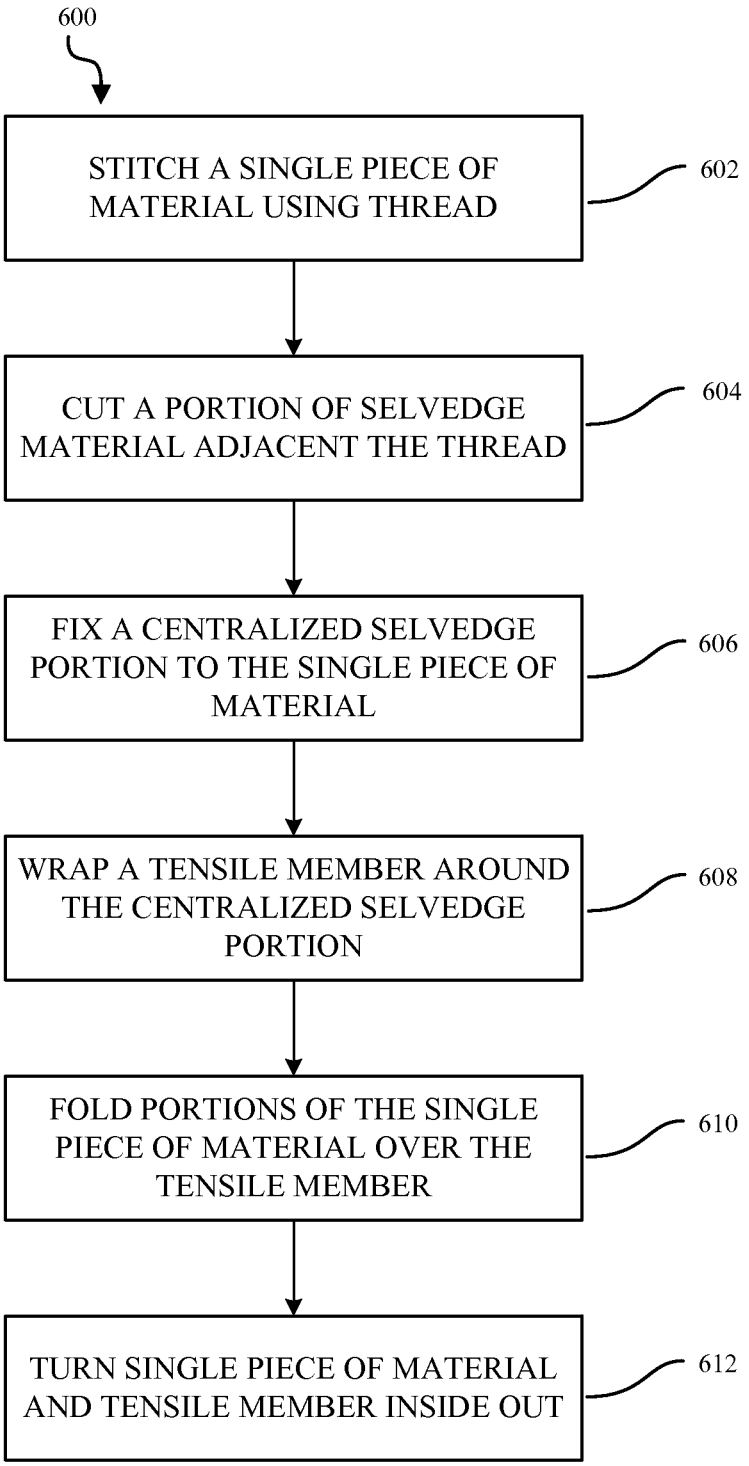
FIG. 10 shows a flow chart illustrating a method of forming a single retention loop for a wearable band. This method may form the retention loop as shown in FIGS. 9A-9M.

FIG. 10 depicts an example process for forming an individual retention loop for a wearable band. that is, FIG. 10 is a flowchart depicting one example process 600 for forming a retention loop for a wearable band. In some cases, the process may be used to form one or more retention loops, as discussed above with respect to FIGS. 9A-9M.

In operation 602, a thread may stitch a single piece of leather material proximate two joined ends of the material. The stitching in operation 602 may form a loop out of the single piece of leather material. In operation 604, a portion of selvedge material formed adjacent the thread may be cut. The cutting of the portion of selvedge material may form an exterior portion and two interior foldable portions of the single piece of leather material. In operation 606, a centralized selvedge portion of the selvedge material may be fixed to the single piece of leather material. The centralized selvedge portion may define the exterior portion of the single piece of the leather material. In operation 608, a tensile member may be wrapped around the centralized selvedge portion and the single piece of the leather material. In operation 610, the two interior foldable portions of the single piece of the leather material may be folded over and/or may cover the tensile member. In operation 612, the single piece of leather and the tensile member may be turned inside out or reversed to expose the outer portion of the single piece of leather material.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

We claim:

1. A retention loop for a watch band, the retention loop comprising:

a bottom layer comprising:

a first reduced thickness portion positioned at a first end of the bottom layer; and a second reduced thickness portion positioned at a second end of the bottom layer and opposite the first end, the second reduced thickness portion coupled to the first reduced thickness portion to maintain a uniform thickness of the bottom layer;

a tensile member encircling the bottom layer; and a top layer encircling the bottom layer and the tensile member, the top layer comprising a seam positioned opposite the first reduced thickness portion and the second reduced thickness portion of the bottom layer.

2. The retention loop of claim 1, wherein the bottom layer is formed from a leather material, and wherein the top layer is formed from the leather material.

3. The retention loop of claim 1, wherein the tensile member is formed from a non-woven material.

4. The retention loop of claim 3, wherein the tensile member is formed from one of:

a polyester material, or a urethane material.

5. The retention loop of claim 1, wherein the first reduced thickness portion is formed on a first surface of the bottom layer, and wherein the second reduced thickness portion is formed on a second surface of the bottom layer and opposite the first surface.

6. The retention loop of claim 1, wherein the tensile member overlaps itself directly above the first and second reduced thickness portions creating two distinct overlapping layers.

7. The retention loop of claim 1, wherein the tensile member is coupled to the bottom layer.

8. The retention loop of claim 1, wherein the tensile member further comprises a plurality of score lines formed partially through the tensile member.

9. The retention loop of claim 1 further comprising exposed ends formed in:

the bottom layer;

the tensile member; and the top layer.

10. The retention loop of claim 9, wherein the exposed ends are at least one of sanded, or painted.

11. A retention loop for a watch band, the retention loop comprising:

a bottom layer;

a tensile member encircling the bottom layer, wherein the tensile member overlaps itself, creating two distinct layers; and a top layer encircling the bottom layer and the tensile member, wherein the tensile member further comprises a plurality of score lines formed partially through the tensile member.

12. The retention loop of claim 11, wherein the bottom layer comprises:

a first reduced thickness portion positioned at a first end of the bottom layer; and a second reduced thickness portion positioned at a second end of the bottom layer and opposite the first end, the second reduced thickness portion coupled to the first reduced thickness portion to maintain a uniform thickness of the bottom layer.

* * * * *